US008114559B2

(12) United States Patent
Shimoyama et al.

(10) Patent No.: US 8,114,559 B2
(45) Date of Patent: Feb. 14, 2012

(54) ELECTROPHOTOGRAPHIC PHOTORECEPTOR, AND IMAGE FORMING APPARATUS AND PROCESS CARTRIDGE USING THE SAME

(75) Inventors: Keisuke Shimoyama, Numazu (JP); Eiji Kurimoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 697 days.

(21) Appl. No.: 12/151,417

(22) Filed: May 5, 2008

(65) Prior Publication Data

US 2008/0280221 A1 Nov. 13, 2008

(30) Foreign Application Priority Data

May 11, 2007 (JP) ..... 2007-126238

(51) Int. Cl.
*G03G 5/047* (2006.01)

(52) U.S. Cl. ..... 430/58.5; 430/57.3; 430/58.75

(58) Field of Classification Search ..... 430/58.5, 430/57.3, 58.75
See application file for complete search history.

(56) References Cited

U.S. PATENT DOCUMENTS

| | | | |
|---|---|---|---|
| 5,882,813 | A | 3/1999 | Matsushima et al. |
| 6,200,717 | B1 | 3/2001 | Takeuchi et al. |
| 6,794,102 | B2 | 9/2004 | Bender et al. |
| 7,267,916 | B2 | 9/2007 | Sugino et al. |
| 7,274,898 | B2 | 9/2007 | Nousho et al. |
| 7,314,693 | B2 | 1/2008 | Ikegami et al. |
| 2005/0058918 | A1 | 3/2005 | Kurimoto et al. |
| 2006/0269323 | A1 | 5/2006 | Kabata et al. |
| 2007/0059039 | A1 | 3/2007 | Shimoyama et al. |
| 2007/0059618 | A1* | 3/2007 | Kurimoto et al. ..... 430/58.5 |
| 2007/0059619 | A1* | 3/2007 | Shimoyama et al. ..... 430/58.7 |
| 2007/0148574 | A1* | 6/2007 | Suzuki et al. ..... 430/60 |
| 2007/0219375 | A1* | 9/2007 | Fujiyama et al. ..... 546/278.7 |
| 2007/0248901 | A1 | 10/2007 | Shimoyama et al. |
| 2007/0264047 | A1 | 11/2007 | Kurimoto et al. |

FOREIGN PATENT DOCUMENTS

| | | | |
|---|---|---|---|
| JP | 57-148745 | A | 9/1982 |
| JP | 59-031965 | A | 2/1984 |
| JP | 59-036254 | A | 2/1984 |
| JP | 59-044054 | A | 3/1984 |
| JP | 59-049544 | A | 3/1984 |
| JP | 59-166959 | A | 9/1984 |
| JP | 61-239248 | A | 10/1986 |
| JP | 62-067094 | A | 3/1987 |
| JP | 63-000366 | A | 1/1988 |
| JP | 63-116158 | A | 5/1988 |
| JP | 64-017066 | A | 1/1989 |
| JP | 09311474 | * | 12/1997 |
| JP | 2001-019871 | A | 1/2001 |
| WO | WO 2005/064415 | A1 | 7/2005 |

OTHER PUBLICATIONS

Abstract of JP 09311474 Dec. 2, 1997.*
Machine English language translation of JP 09311474 Dec. 2, 1997.*
W. Herbst et al., Industrial Organic Pigments, 3d, Completely Revised Ed. (Wiley-VCH, [2004]), pp. 472-487. European Patent Office, communication dated Jun. 25, 2008 in European Patent Application EP 08 155 939 (Ricoh Company, Ltd.).
European Patent Office, communication dated Aug. 26, 2011 in European Patent Application No. 08 155 939.5-1217 (Ricoh Company, Ltd.).

* cited by examiner

*Primary Examiner* — Hoa Le
(74) *Attorney, Agent, or Firm* — Cooper & Dunham LLP

(57) ABSTRACT

An electrophotographic photoreceptor including a conductive substrate; and a photosensitive layer located overlying the conductive substrate, including a charge generation material, an electron transport material having a specific formula, and a hole transport material having a specific formula.

5 Claims, 6 Drawing Sheets

ELECTROPHOTOGRAPHIC PHOTORECEPTOR, AND IMAGE FORMING APPARATUS AND PROCESS CARTRIDGE USING THE SAME

BACKGROUND OF THE INVENTION

1. Field of the Invention

The present invention relates to an electrophotographic photoreceptor. In addition, the present invention also relates to an image forming apparatus and a process cartridge using the electrophotographic photoreceptor.

2. Discussion of the Related Art

Information processing system apparatuses using electrophotography have been drastically improved recently. Particularly, optical printers in which information is recorded by means of light have been extremely improved in terms of printing quality and reliability. Such a recording technique, so-called a digital recording technique, is applied not only to printers but also to copiers. It is expected that demands for digital copiers, having various additional image processing functions, may grow more and more. In addition, digital color printers have been also drastically improved along with widespread use and improvement of personal computers. The above-described information processing system apparatuses using electrophotography are hereinafter referred to as "image forming apparatuses".

A typical image forming apparatus includes an electrophotographic photoreceptor (hereinafter simply referred to as the "photoreceptor"). The photoreceptors are broadly classified into organic photoreceptors and inorganic photoreceptors. The organic photoreceptors are widely used recently because of being easily manufacturable at low cost and having a flexibility in choosing materials such as charge transport materials, charge generation materials, and binder resins.

The organic photoreceptors are classified into single-layer photoreceptors including a photosensitive layer in which a charge transport material (e.g., a hole transport material, an electron transport material) and a charge generation material are dispersed, and multilayer photoreceptors in which a charge generation layer including a charge generation material and a charge transport layer including a charge transport material are overlaid on each other.

Most of practical multilayer photoreceptors are negatively chargeable. In contrast, any positively chargeable multilayer photoreceptor has not yet come into practical use. This is because electron transport materials having good electron transportability, less toxicity, and high compatibility with binder resins have not yet come into practical use.

However, there is a disadvantage that negatively chargeable photoreceptors are much unstably charged by corona discharge compared to positively chargeable photoreceptors, while producing ozone and nitrogen oxides. The ozone and nitrogen oxides produced tend to adhere to the surface of the photoreceptor, resulting in physical and chemical deterioration thereof. For this reason, positively chargeable photoreceptors have an advantage over negatively chargeable photoreceptors in terms of flexibility in use conditions and wide application.

The positively chargeable photoreceptors include single-layer photoreceptors. The single-layer photoreceptors have attracted attention recently for the following reasons: being manufacturable with simple processes; having good optical properties because of including few interfaces between layers; having both positive and negative sensitivity because of including both an electron transport material and a hole transport material; and being evenly chargeable while producing a less amount of ozone.

On the other hand, novel electron transport materials have been developed recently. For example, United States Patent Application Publication No. 2007/0219375 discloses derivatives of a tetracarboxylic acid and a naphthalene carboxylic acid. It is disclosed therein that these compounds have good electron transportability and enhance electrostatic properties of single-layer photoreceptors.

However, these compounds do not have satisfactory stability in electrostatic properties when repeatedly used. In addition, single-layer photoreceptors including these compounds have poor charge stability, and therefore chargeability thereof deteriorates after repeated use. Consequently, abnormal images with background fouling tend to be produced.

Single-layer photoreceptors also have a disadvantage that residual images are easily produced.

In a typical single-layer photoreceptor, charge generation materials are included all over the layer. Therefore, charge generation areas spread all over the layer. When pairs of hole and electron are formed all over the layer, movements of holes and electrons are disturbed due to difference in mobility between hole and electron, structural defect, and recombination. As a result, carriers (i.e., holes and electrons) are retained in a portion which is irradiated with a light beam in an irradiation process. Subsequently, the portion, having a potential difference, is irradiated again in the next charging process. Consequently, image density unevenness is caused in the resultant image.

SUMMARY OF THE INVENTION

Accordingly, an object of the present invention is to provide a single-layer electrophotographic photoreceptor which has high sensitivity and stable electrostatic properties even after repeated use.

Another object of the present invention is to provide an image forming apparatus which can produce images without background fouling and residual image for a long period of time.

Another object of the present invention is to provide a process cartridge which is easy to handle.

To achieve such objects, the present invention contemplates the provision of an electrophotographic photoreceptor, comprising:

a conductive substrate; and a photosensitive layer located overlying the conductive substrate, comprising:

a charge generation material;

an electron transport material having the following formula (1):

(1)

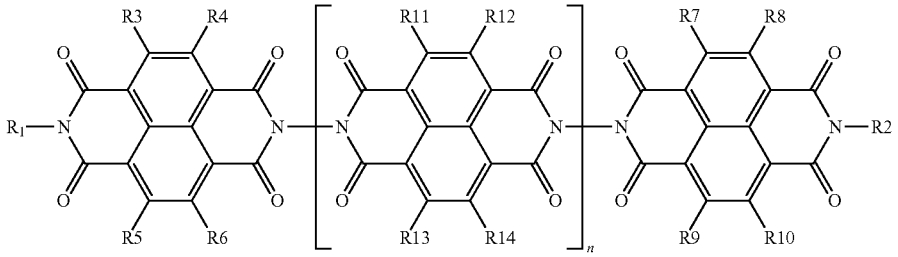

wherein each of R1 and R2 independently represents a hydrogen atom, a substituted or unsubstituted alkyl group, a substituted or unsubstituted cycloalkyl group, or a substituted or unsubstituted aralkyl group; each of R3 to R14 independently represents a hydrogen atom, a halogen atom, a cyano group, an amino group, a hydroxyl group, a substituted or unsubstituted alkyl group, a substituted or unsubstituted cycloalkyl group, or a substituted or unsubstituted aralkyl group; and n represents an integer of from 0 to 100; and a hole transport material having the following formula (2):

(2)

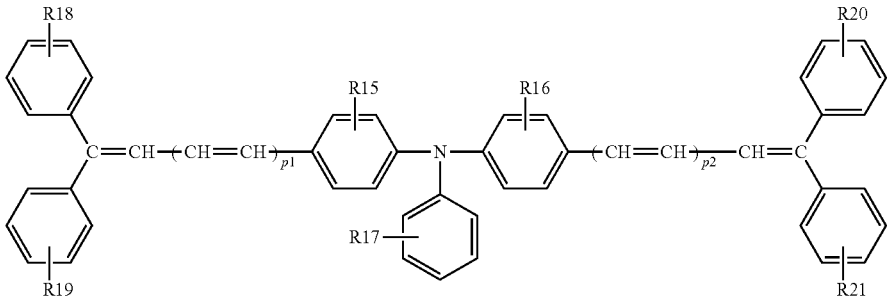

wherein each of R15 to R21 independently represents a hydrogen atom, a lower alkyl group, an alkoxy group, a phenoxy group, a halogen atom, or an aryl group which may have a substituent group; and each of p1 and p2 independently represents an integer of 0 or 1;

and an image forming apparatus and a process cartridge using the above electrophotographic photoreceptor.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
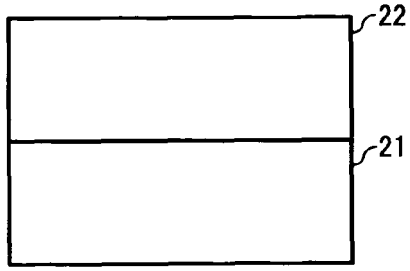
FIG. 1 is a cross-sectional schematic view illustrating an embodiment of the photoreceptor of the present invention.

The present invention will be explained in detail.

As mentioned above, residual image is produced because carriers (i.e., holes and electrons) are retained in a portion which is irradiated with a light beam. Therefore, single-layer photoreceptors need to have both satisfactory electron transportability and hole transportability.

Typically, carriers (i.e., holes and electrons) tend to be retained because an electron transport material has unsatisfactory electron transportability. The electron transport material having the formula (1) used in the present invention has good electron transportability.

However, an electron transport material and a hole transport material typically form a charge-transfer complex.

Therefore, each of the electron transport material and the hole transport material may not independently function in a single-layer photoreceptor in some cases. Even if the electron transport material having the formula (1) having good electron transportability and a hole transport material having good hole transportability are used in combination, the resultant photoreceptor may not have satisfactory charge transportability in some cases. As a result, residual image may be produced and electrophotographic properties of the photoreceptor may deteriorate after repeated use.

To prevent the occurrence of the above-described problem, both the electron transport material and the hole transport material may have good transportability, and in addition, a combination of the electron transport material and the hole transport material may be optimized.

When the electron transport material having the formula (1) and the hole transport material having the formula (2) are used in combination, each of the materials (1) and (2) independently functions, resulting in provision of a highly-sensitive photoreceptor having good combination of electron mobility and hole mobility. Such a photoreceptor does not produce residual image and has stable sensitivity, residual potential, and electrostatic properties, even after being repeatedly used. This is because the electron transport material having the formula (1) and the hole transport material having the formula (2) have good compatibility with each other, and the electron transport material having the formula (1) has good resistance to oxidized gases produced in a charging process.

The use of a specific charge generation material also improves electrophotographic properties of a photoreceptor. Any known charge generation materials can be used in the present invention, however, a charge generation material having a phthalocyanine structure is preferably used in combination with the electron transport material having the formula (1) and the hole transport material having the formula (2). Thereby, the resultant photoreceptor does not deteriorate even after being repeatedly used.

In particular, a photoreceptor including a titanyl phthalocyanine including titanium as the central metal, having the following formula (3), has high sensitivity:

(3)

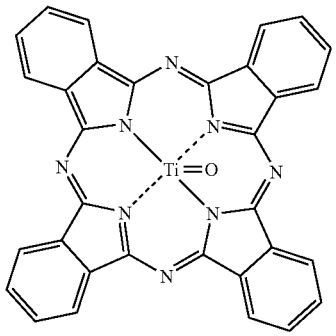

Such a highly-sensitive photoreceptor can provide a high-speed image forming apparatus.

Synthesis methods and electrophotographic properties of titanyl phthalocyanine are disclosed in Unexamined Japanese Patent Application Publications Nos. (hereinafter referred to as JP-A) 57-148745, 59-36254, 59-44054, 59-31965, 61-239248, and 62-67094. Various crystal systems of titanyl phthalocyanine are disclosed in JP-As 59-49544, 59-166959, 61-239248, 62-67094, 63-366, 63-116158, 64-17066, and 2001-19871.

Among these, a titanyl phthalocyanine having a maximum diffraction peak at 27.2° as a diffraction peak of Bragg angles (2θ±0.2°) has excellent sensitivity. Specifically, a titanyl phthalocyanine disclosed in JP-A 2001-19871, having a maximum diffraction peak at 27.2°, main diffraction peaks at 9.4°, 9.6°, and 24.0°, a lowest-side-angle diffraction peak at 7.3°, and no diffraction peak in a range of greater than 7.3° and less than 9.4°, as diffraction peaks of Bragg angles (2θ±0.2°) with a characteristic X-ray specific to CuKα having a wavelength of 1.542 Å, can provide a photoreceptor which stably has high sensitivity. Chargeability of such a photoreceptor does not deteriorate even after repeated use.

FIG. 1 is a cross-sectional schematic view illustrating an embodiment of the photoreceptor of the present invention. A photosensitive layer 22 is overlaid on a conductive substrate 21.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

Suitable materials for use as the conductive substrate 21 include material having a volume resistivity not greater than $10^{10}\Omega\cdot$cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate, which is prepared by tubing a metal such as aluminum, aluminum alloys, nickel, and stainless steel by a method such as a drawing and ironing method, an impact ironing method, an extruded ironing method, and an extruded drawing method, and then treating the surface of the tube by cutting, super finishing, polishing, and the like treatments.

The photosensitive layer 22 includes a charge generation material, the electron transport material having the formula (1), and the hole transport material having the formula (2).

First, the charge generation material will be explained in detail.

Any known charge generation materials can be used for the present invention. Specific preferred examples of suitable charge generation materials include, but are not limited to, phthalocyanine pigments such as metal phthalocyanine and metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone or polycyclic quinone pigments, quinonimine pigments, diphenylmethane or triphenylmethane pigments, benzoquinone or naphthoquinone pigments, cyanine or azomethine pigments, indigoid pigments, and bisbenzimidazole pigments. These charge generation materials can be used alone or in combination.

Among these charge generation materials, phthalocyanine pigments are preferably used. Specifically, as mentioned above, a titanyl phthalocyanine including titanium as the central metal, having the formula (3), has high sensitivity, being capable of providing a high-speed image forming apparatus.

Furthermore, a titanyl phthalocyanine having a maximum diffraction peak at 27.2° as a diffraction peak of Bragg angles (2θ±0.2°) has excellent sensitivity. Specifically, a titanyl phthalocyanine disclosed in JP-A 2001-19871, having a maximum diffraction peak at 27.2°, main diffraction peaks at 9.4°, 9.6°, and 24.0°, a lowest-side-angle diffraction peak at 7.3°, and no diffraction peak in a range of greater than 7.3° and less than 9.4°, as diffraction peaks of Bragg angles (2θ±0.2°) with a characteristic X-ray specific to CuKα having a wavelength of 1.542 Å, can provide a photoreceptor which stably has high sensitivity. Chargeability of such a photoreceptor does not deteriorate even after repeated use.

Next, the electron transport material will be explained in detail.

An electron transport material having the following formula (1) is used for the present invention:

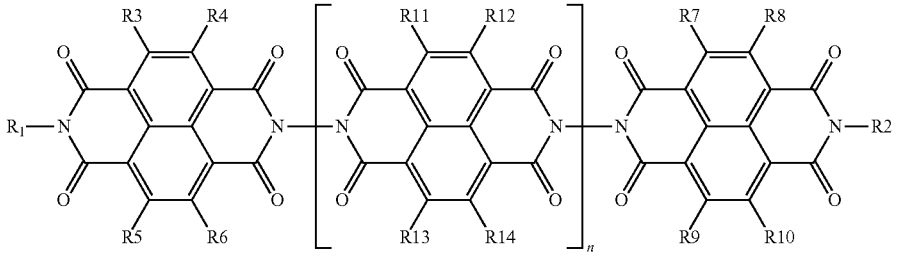

(1)

wherein each of R1 and R2 independently represents a hydrogen atom, a substituted or unsubstituted alkyl group, a substituted or unsubstituted cycloalkyl group, or a substituted or unsubstituted aralkyl group; each of R3 to R14 independently represents a hydrogen atom, a halogen atom, a cyano group, an amino group, a hydroxyl group, a substituted or unsubstituted alkyl group, a substituted or unsubstituted cycloalkyl group, or a substituted or unsubstituted aralkyl group; and n represents an integer of from 0 to 100.

Specific examples of the substituted or unsubstituted alkyl groups include, but are not limited to, alkyl groups having 1 to 25, preferably 1 to 10, carbon atoms including straight-chain alkyl groups (e.g., methyl group, ethyl group, n-propyl group, n-butyl group, n-pentyl group, n-hexyl group, n-heptyl group, n-octyl group, n-nonyl group, n-decyl group) and branch-chain alkyl groups (e.g., i-propyl group, s-butyl group, t-butyl group, methylpropyl group, dimethylpropyl group, ethylpropyl group, diethylpropyl group, methylbutyl group, dimethylbutyl group, methylpentyl group, dimethylpentyl group, methylhexyl group, dimethylhexyl group), alkoxyalkyl groups, monoalkylaminoalkyl groups, dialkylaminoalkyl groups, halogen-substituted alkyl groups, alkylcarbonylalkyl groups, carboxyalkyl groups, alkanoyloxyalkyl groups, aminoalkyl groups, alkyl groups substituted with a carboxyl group which may be esterified, and alkyl groups substituted with a cyano group. The substitution site of the substituted alkyl groups is not particularly limited. Alkyl groups in which a part of carbon atoms are substituted with a heteroatom (such as N, O, and S) are also included in the substituted alkyl groups.

Specific examples of the substituted or unsubstituted cycloalkyl groups include, but are not limited to, cycloalkyl rings having 3 to 25, preferably 3 to 10, carbon atoms including congeneric cycloalkyl rings (e.g., cyclopropane to cyclodecane), cycloalkyl rings having an alkyl substituent group (e.g., methylcyclopentane, dimethylcyclopentane, methylcyclohexane, dimethylcyclohexane, trimethylcyclohexane, tetramethylcyclohexane, ethylcyclohexane, diethylcyclohexane, t-butylcyclohexane), and cycloalkyl groups substituted with an alkoxyalkyl group, a monoalkylaminoalkyl group, a dialkylaminoalkyl group, a halogen-substituted alkyl group, an alkylcarbonylalkyl group, a carboxyalkyl group, an alkanoyloxyalkyl group, an aminoalkyl group, a halogen atom, an amino group, a carboxyl group which may be esterified, and a cyano group. The substitution site of the substituted cycloalkyl groups is not particularly limited. Cycloalkyl groups in which a part of carbon atoms are substituted with a heteroatom (such as N, O, and S) are also included in the substituted cycloalkyl groups.

Specific examples of the substituted or unsubstituted aralkyl groups include, but are not limited to, the above-described substituted or unsubstituted alkyl groups substituted with an aromatic ring and having 6 to 14 carbon atoms, such as benzyl group, perfluorophenylethyl group, 1-phenylethyl group, 2-phenylethyl group, terphenylethyl group, dimethylphenylethyl group, diethylphenylethyl group, t-butylphenylethyl group, 3-phenylpropyl group, 4-phenylbutyl group, 5-phenylpentyl group, 6-phenylhexyl group, benzhydryl group, and trityl group.

Specific examples of the halogen atoms include, but are not limited to, fluorine, chlorine, bromine, and iodine.

The electron transport material having the formula (1) can be synthesized by the following two methods:
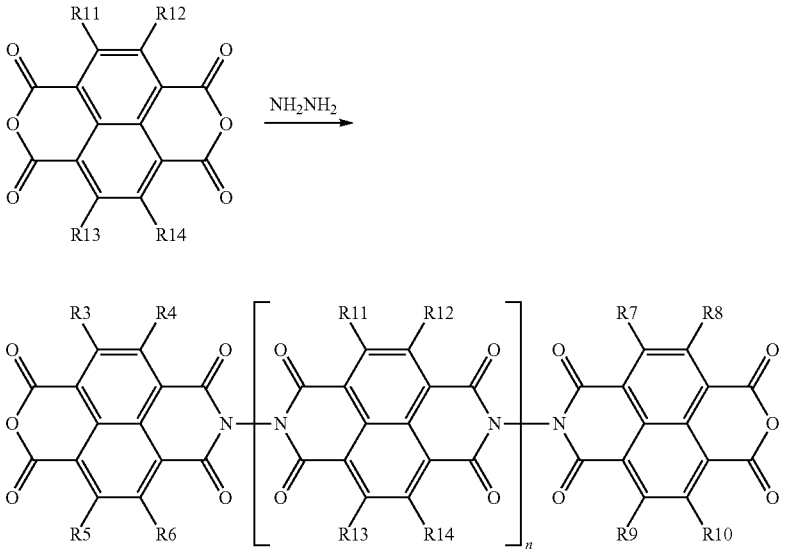
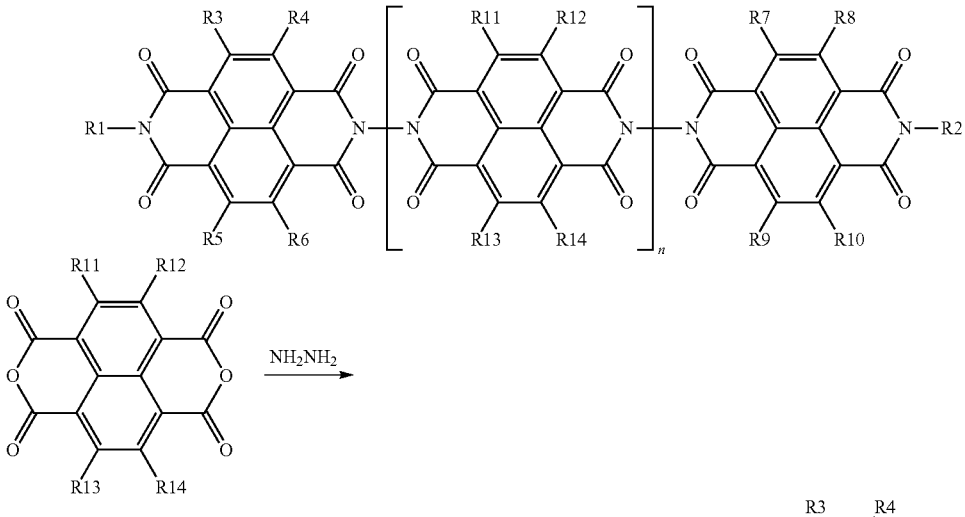

The former method is employed when R3=R7=R11, R4=R8=R12, R5=R9=R13, and R6=R10=R14.

A starting material for synthesizing the electron transport material having the formula (1) can be prepared as follows.

For example, a naphthalenecarboxylic acid can be prepared as follows according to a method disclosed in U.S. Pat. No. 6,794,102, a reference entitled "Industrial Organic Pigments, 3rd, Completely Revised Edition, Wiley-VCH, 472-487 (2004)", etc.:

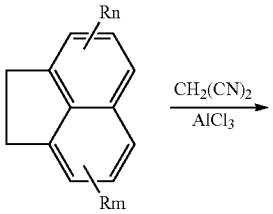

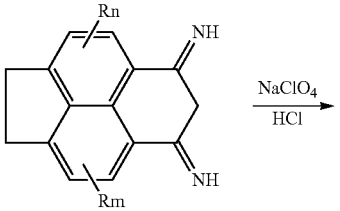

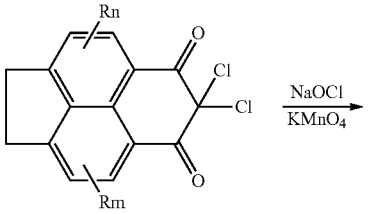

-continued

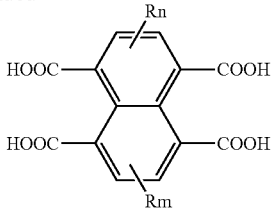

wherein Rn represents R3, R4, R7, and R8, and Rm represents R5, R6, R9, and R10.

The electron transport material having the formula (1) can be prepared by reacting the above-prepared naphthalenecarboxylic acid or an anhydride thereof with an amide (i.e., monoimidization); or reacting the above-prepared naphthalenecarboxylic acid or an anhydride thereof with a diamine while controlling the pH using a buffer solution. The monoimidization is performed without or in the presence of a solvent. Specific preferred examples of suitable solvents include, but are not limited to, benzene, toluene, xylene, chloronaphthalene, acetic acid, pyridine, methylpyridine, dimethylformaldehyde, dimethylacetamide, dimethylethyleneurea, and dimethylsulfoxide, which do not react with raw materials and products at 50 to 250° C. Specific examples of the buffer solution used for controlling the pH include a buffer solution in which a basic aqueous solution such as an aqueous solution of potassium hydroxide and an acid such as phosphoric acid are mixed. A dehydration reaction of a, carboxylic acid derivative, prepared by reacting a carboxylic acid with an amine or a diamine, is performed either in the absence or presence of a solvent. Specific preferred examples of suitable solvents include, but are not limited to, benzene, toluene, chloronaphthalene, bromonaphthalene, and acetic anhydride, which do not react with raw materials and products at 50 to 250° C. Each of the above-described reactions can be performed either in the absence or presence of a catalyst. For example, molecular sieves, benzenesulfonic acid, and p-toluenesulfonic acid can be mentioned as examples of usable dehydrators.

The electron transport material having the formula (1) (hereinafter the "material (1)") includes a repeating unit n representing an integer of from 0 to 100. The repeating unit n can be calculated from the weight average molecular weight (Mw). Molecules constituting the material (1) typically have a molecular weight distribution. A molecule in which the n is greater than 100 has a large molecular weight and has poor solubility in various solvents. Therefore, then is preferably 100 or less. In particular, the n is preferably 0, i.e., the molecules constituting material (1) are preferably dimers, in terms of solubility and electrophotographic property.

When the n is 1, the molecules constituting material (1) are trimers of a naphthalenecarboxylic acid. By choosing appropriate substituent groups of R1 and R2, good electron transportability can be provided even if the molecules constituting material (1) are oligomers. Various naphthalenecarboxylic acid derivatives, from oligomers to polymers, can be prepared by varying the repeating unit n.

Oligomers having a small molecular weight can provide the resultant material (1) having a monodisperse molecular weight dispersion, by performing a synthesis step by step. Polymer having a large molecular weight provides the resultant material (1) having a molecular weight dispersion.

Specific examples of the electron transport material having the following formula (1) include, but are not limited to, compounds shown in Tables 1-1 to 1-3:

TABLE 1-1
(1)
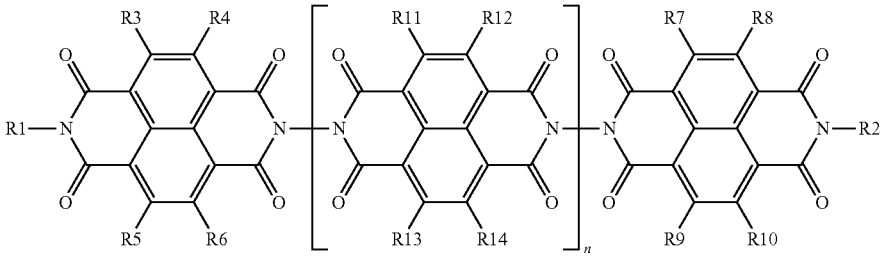
| Compound No. | Structural Formula |
|---|---|
| 1-1 | 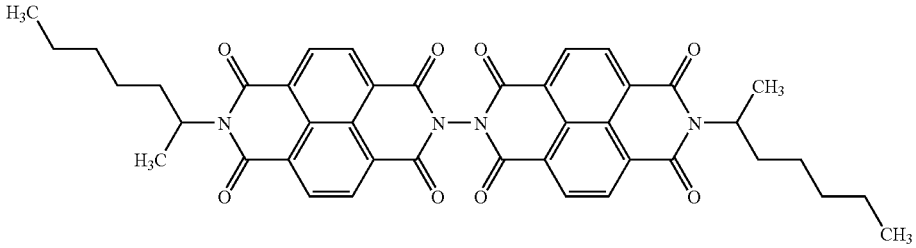 |
| 1-2 | 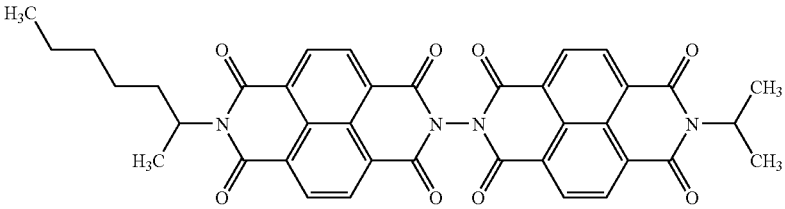 |
| 1-3 | 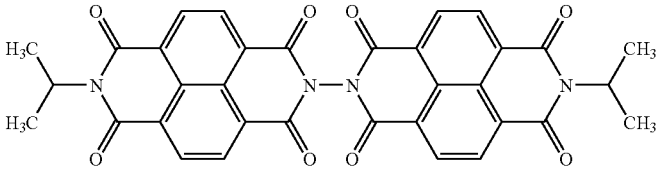 |
| 1-4 | 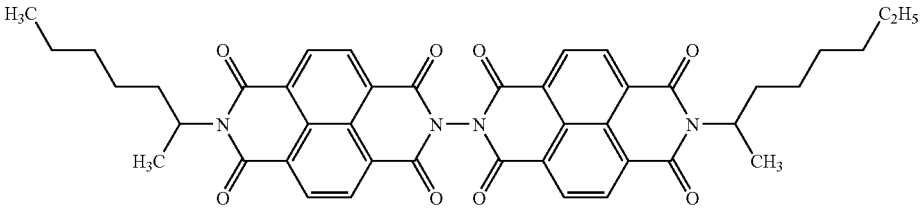 |
| 1-5 | 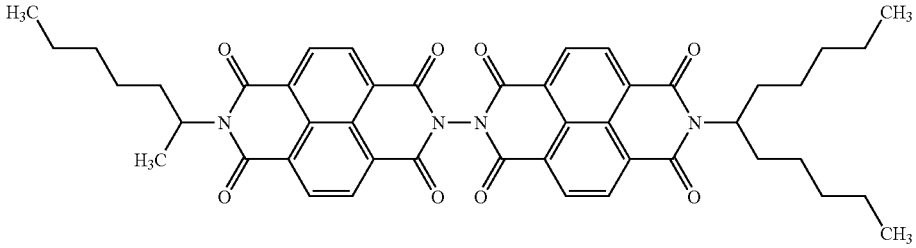 |
| 1-6 | 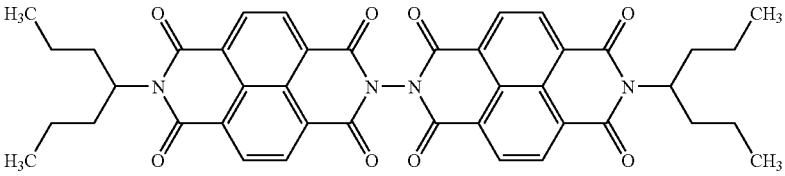 |

TABLE 1-1-continued
(1)
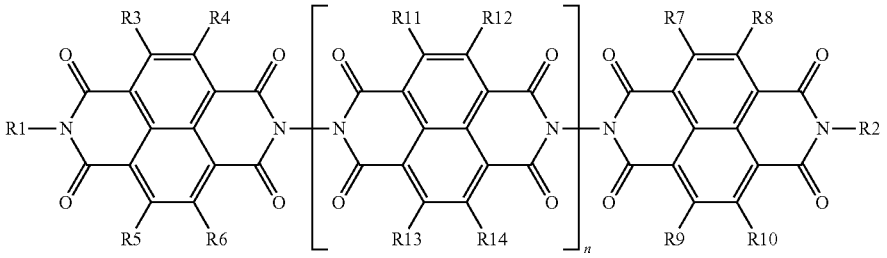
| Compound No. | Structural Formula |
|---|---|
| 1-7 | 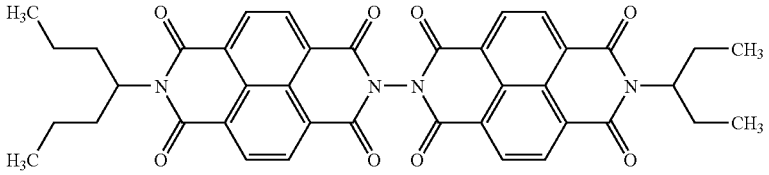 |
TABLE 1-2
| Compound No. | Structural Formula |
|---|---|
| 1-8 | 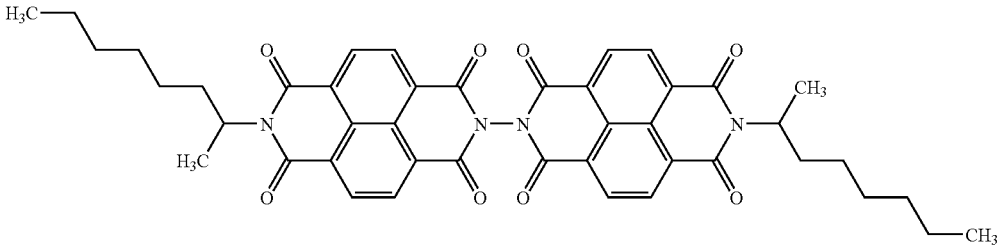 |
| 1-9 | 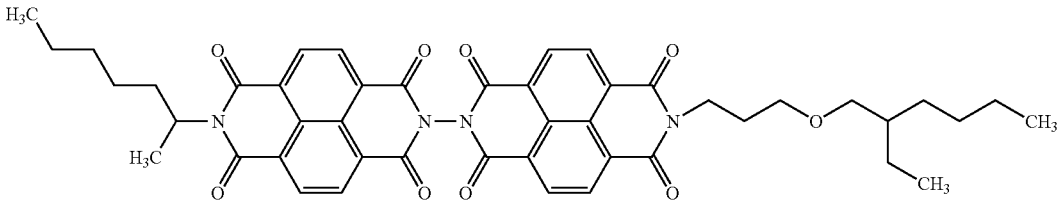 |
| 1-10 | 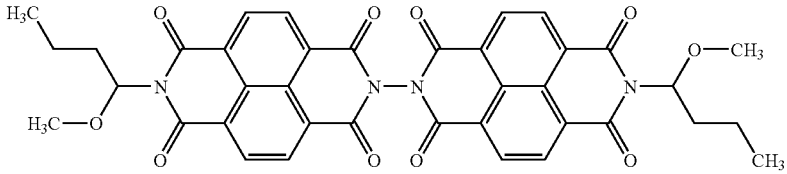 |
| 1-11 | 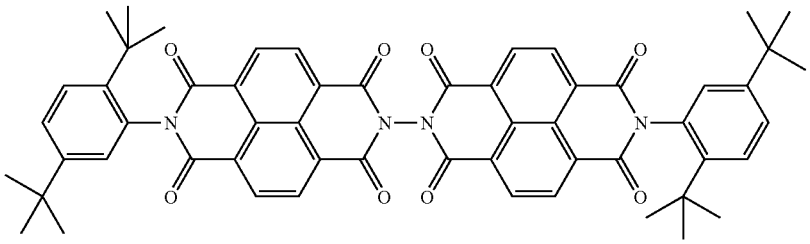 |

TABLE 1-2-continued
| Compound No. | Structural Formula |
|---|---|
| 1-12 | 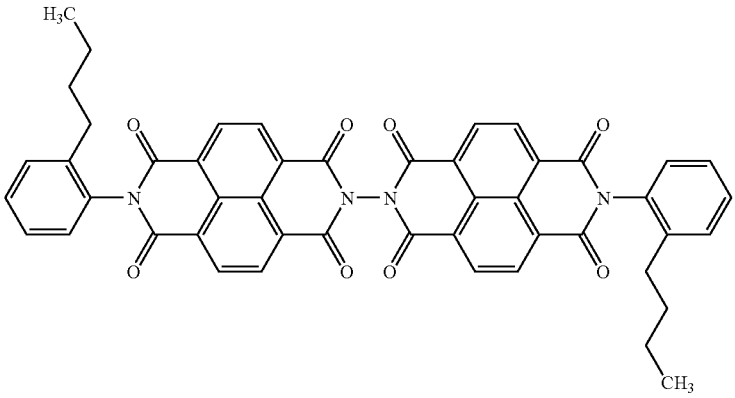 |
| 1-13 | 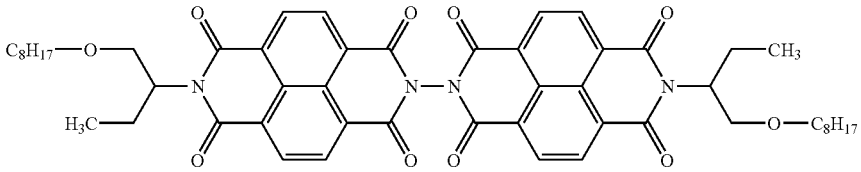 |
| 1-14 | 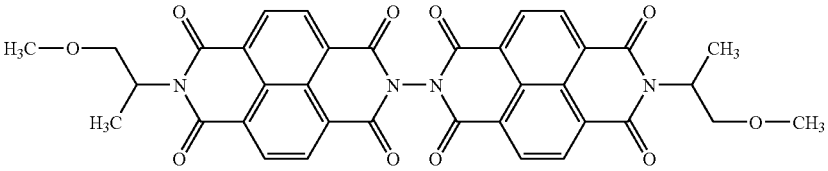 |
TABLE 1-3
| Compound No. | Structural Formula |
|---|---|
| 1-15 | 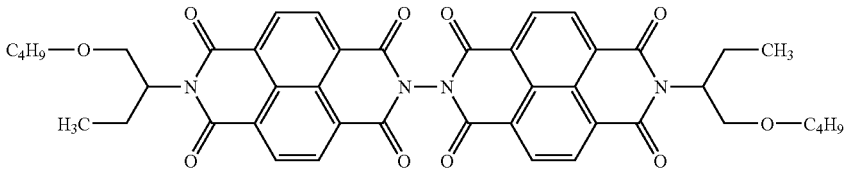 |
| 1-16 | 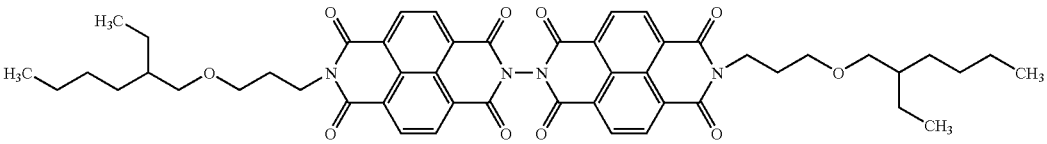 |
| 1-17 | 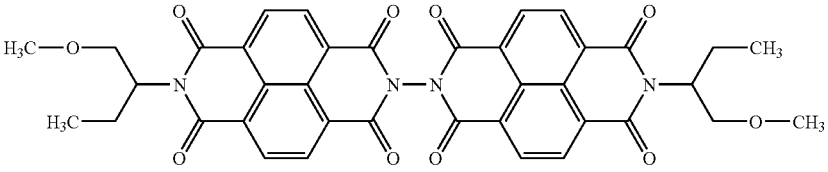 |

TABLE 1-3-continued

| Compound No. | Structural Formula |
|---|---|
| 1-18 | 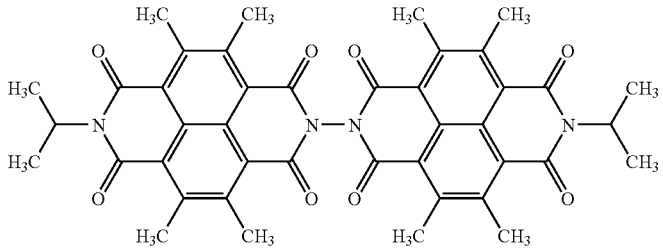 |
| 1-19 | 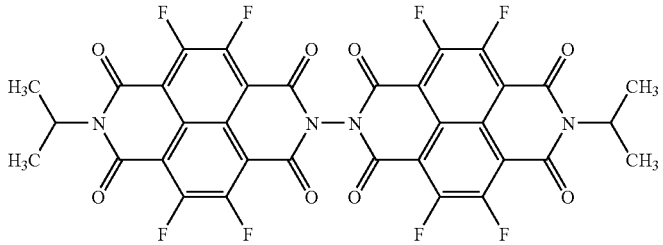 |
| 1-20 | 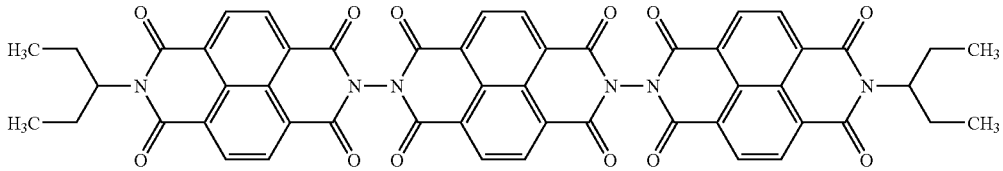 |
| 1-21 | 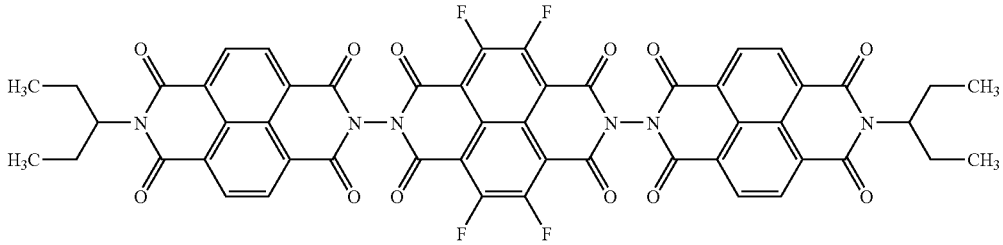 |

Next, the hole transport material will be explained in detail.

A hole transport material having the following formula (2) is used for the present invention:

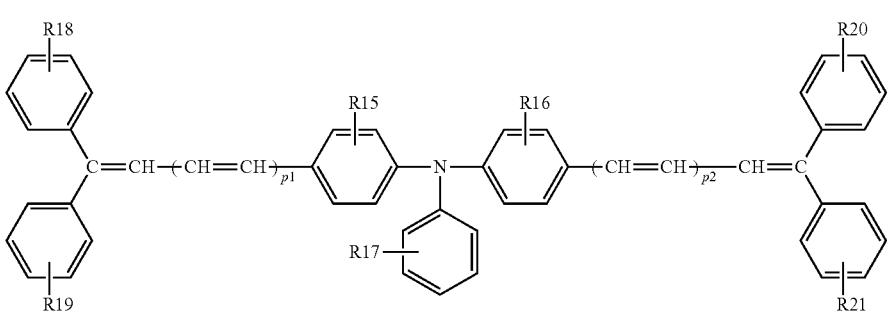

(2)

wherein each of R15 to R21 independently represents a hydrogen atom, a lower alkyl group, an alkoxy group, a phenoxy group, a halogen atom, or an aryl group which may have a substituent group; and each of p1 and p2 independently represents an integer of 0 or 1.

Specific examples of the lower alkyl group in the formula (2) include, but are not limited to, straight-chain and branched-chain alkyl groups having 1 to 4 carbon atoms such as methyl group, ethyl group, propyl group, and butyl group.

Specific examples of the alkoxy group in the formula (2) include, but are not limited to, methoxy group, ethoxy group, and propoxy group.

Specific examples of the halogen atom in the formula (2) include, but are not limited to, fluorine, chlorine, bromine, and iodine.

Specific examples of the aryl group in the formula (2) include, but are not limited to, phenyl group, naphthyl group, and anthryl group. These aryl groups may have a substituent group. Specific examples of the substituent group include, but are not limited to, the above-described lower alky groups, alkoxy groups and the halogen atoms.

Specific examples of combinations of R15 to R21, p1, and p2 in the hole transport material having the formula (2) are shown in Tables 2-1 to 2-3.

TABLE 2-1

| Compound No. | R15 | R16 | R17 | R18 | R19 | R20 | R21 | p1 | p2 |
|---|---|---|---|---|---|---|---|---|---|
| BTA-01 | H | H | H | H | H | H | H | 0 | 0 |
| BTA-02 | H | H | H | 4-$CH_3$ | 4-$CH_3$ | 4-$CH_3$ | 4-$CH_3$ | 0 | 0 |
| BTA-03 | H | 3-$CH_3$ | H | H | H | 4-$CH_3$ | 4-$CH_3$ | 0 | 0 |
| BTA-04 | H | H | H | 4-$CH_3$ | H | 4-$CH_3$ | H | 0 | 0 |
| BTA-05 | H | H | H | 3-$CH_3$ | H | 3-$CH_3$ | H | 0 | 0 |
| BTA-06 | H | H | H | H | H | 4-Cl | 4-Cl | 0 | 0 |
| BTA-07 | H | H | 4-$CH_3$ | H | H | H | H | 0 | 0 |
| BTA-08 | H | H | 4-$CH_3$ | 4-$CH_3$ | 4-$CH_3$ | 4-$CH_3$ | 4-$CH_3$ | 0 | 0 |
| BTA-09 | 3-$CH_3$ | 3-$CH_3$ | 4-$CH_3$ | H | H | 4-$CH_3$ | 4-$CH_3$ | 0 | 0 |
| BTA-10 | H | H | 4-$CH_3$ | 4-$CH_3$ | H | 4-$CH_3$ | H | 0 | 0 |
| BTA-11 | H | H | 4-$CH_3$ | 3-$CH_3$ | H | 3-$CH_3$ | H | 0 | 0 |
| BTA-12 | H | H | 4-$CH_3$ | H | H | 4-Cl | 4-Cl | 0 | 0 |
| BTA-13 | H | H | 2-$CH_3$ | H | H | H | H | 0 | 0 |
| BTA-14 | H | H | 2-$CH_3$ | 4-$CH_3$ | 4-$CH_3$ | 4-$CH_3$ | 4-$CH_3$ | 0 | 0 |
| BTA-15 | H | H | 2-$CH_3$ | H | H | 4-$CH_3$ | 4-$CH_3$ | 0 | 0 |
| BTA-16 | H | H | 2-$CH_3$ | 4-$CH_3$ | H | 4-$CH_3$ | H | 0 | 0 |
| BTA-17 | H | 3-$OCH_3$ | 2-$CH_3$ | 3-$CH_3$ | H | 3-$CH_3$ | H | 0 | 0 |
| BTA-18 | H | H | 2-$CH_3$ | H | H | 4-Cl | 4-Cl | 0 | 0 |
| BTA-19 | H | H | 4-$OCH_3$ | H | H | H | H | 0 | 0 |
| BTA-20 | H | H | 4-$OCH_3$ | 4-$CH_3$ | 4-$CH_3$ | 4-$CH_3$ | 4-$CH_3$ | 0 | 0 |
| BTA-21 | H | H | 4-$OCH_3$ | H | H | 4-$CH_3$ | 4-$CH_3$ | 0 | 0 |
| BTA-22 | H | H | 4-$OCH_3$ | 4-$CH_3$ | H | 4-$CH_3$ | H | 0 | 0 |
| BTA-23 | H | H | 4-$OCH_3$ | 3-$CH_3$ | H | 3-$CH_3$ | H | 0 | 0 |
| BTA-24 | H | H | 4-$OCH_3$ | H | H | 4-Cl | 4-Cl | 0 | 0 |
| BTA-25 | H | H | 4-Br | 4-$CH_3$ | 4-$CH_3$ | 4-$CH_3$ | 4-$CH_3$ | 0 | 0 |
| BTA-26 | H | H | 4-Br | 4-$CH_3$ | H | 4-$CH_3$ | H | 0 | 0 |
| BTA-27 | H | H | 4-Br | 4-F | 4-F | 4-F | 4-F | 0 | 0 |
| BTA-28 | H | H | 4-Br | H | H | H | H | 0 | 0 |
| BTA-29 | H | H | H | H | H | H | H | 1 | 0 |
| BTA-30 | H | H | H | 4-$CH_3$ | 4-$CH_3$ | 4-$CH_3$ | 4-$CH_3$ | 1 | 0 |
| BTA-31 | H | H | H | H | H | 4-$CH_3$ | 4-$CH_3$ | 1 | 0 |
| BTA-32 | H | H | H | 4-$CH_3$ | H | 4-$CH_3$ | H | 1 | 0 |
| BTA-33 | H | H | H | 4-$CH_3$ | 4-$CH_3$ | H | H | 1 | 0 |
| BTA-34 | H | H | H | H | H | 4-Cl | 4-Cl | 1 | 0 |
| BTA-35 | H | H | 4-$CH_3$ | H | H | H | H | 1 | 0 |
| BTA-36 | H | H | 4-$CH_3$ | 4-$CH_3$ | 4-$CH_3$ | 4-$CH_3$ | 4-$CH_3$ | 1 | 0 |
| BTA-37 | 3-$CH_3$ | 3-$CH_3$ | 4-$CH_3$ | H | 4-$CH_3$ | 4-$CH_3$ | 4-$CH_3$ | 1 | 0 |

TABLE 2-2

| Compound No. | R15 | R16 | R17 | R18 | R19 | R20 | R21 | p1 | p2 |
|---|---|---|---|---|---|---|---|---|---|
| BTA-38 | H | H | 4-$CH_3$ | 4-$CH_3$ | H | 4-$CH_3$ | H | 1 | 0 |
| BTA-39 | H | H | 4-$CH_3$ | 3-$CH_3$ | H | 3-$CH_3$ | H | 1 | 0 |
| BTA-40 | H | H | 4-$CH_3$ | H | H | 4-Cl | 4-Cl | 1 | 0 |
| BTA-41 | H | H | 2-$CH_3$ | H | H | H | H | 1 | 0 |
| BTA-42 | H | H | 2-$CH_3$ | 4-$CH_3$ | 4-$CH_3$ | 4-$CH_3$ | 4-$CH_3$ | 1 | 0 |
| BTA-43 | H | H | 2-$CH_3$ | H | H | 4-$CH_3$ | 4-$CH_3$ | 1 | 0 |
| BTA-44 | H | H | 2-$CH_3$ | 4-$CH_3$ | H | 4-$CH_3$ | H | 1 | 0 |
| BTA-45 | H | 3-$OCH_3$ | 2-$CH_3$ | 3-$CH_3$ | H | 3-$CH_3$ | H | 1 | 0 |
| BTA-46 | H | H | 2-$CH_3$ | H | H | 4-Cl | 4-Cl | 1 | 0 |
| BTA-47 | H | H | 4-$OCH_3$ | H | H | H | H | 1 | 0 |
| BTA-48 | H | H | 4-$OCH_3$ | 4-$CH_3$ | 4-$CH_3$ | 4-$CH_3$ | 4-$CH_3$ | 1 | 0 |
| BTA-49 | H | H | 4-$OCH_3$ | H | H | 4-$CH_3$ | 4-$CH_3$ | 1 | 0 |
| BTA-50 | H | H | 4-$OCH_3$ | 4-$CH_3$ | H | 4-$CH_3$ | H | 1 | 0 |
| BTA-51 | H | H | 4-$OCH_3$ | 3-$CH_3$ | H | 3-$CH_3$ | H | 1 | 0 |
| BTA-52 | H | H | 4-$OCH_3$ | H | H | 4-Cl | 4-Cl | 1 | 0 |
| BTA-53 | H | H | 4-Br | 4-$CH_3$ | 4-$CH_3$ | 4-$CH_3$ | 4-$CH_3$ | 1 | 0 |
| BTA-54 | H | H | 4-Br | 4-$CH_3$ | H | 4-$CH_3$ | H | 1 | 0 |
| BTA-55 | H | H | 4-Br | 4-F | 4-F | 4-F | 4-F | 1 | 0 |
| BTA-56 | H | H | 4-Br | H | H | H | H | 1 | 0 |
| BTA-57 | H | H | H | H | H | H | H | 1 | 1 |
| BTA-58 | H | H | H | 4-$CH_3$ | 4-$CH_3$ | 4-$CH_3$ | 4-$CH_3$ | 1 | 1 |
| BTA-59 | H | 3-$CH_3$ | H | H | H | 4-$CH_3$ | 4-$CH_3$ | 1 | 1 |
| BTA-60 | H | H | H | 4-$CH_3$ | H | 4-$CH_3$ | H | 1 | 1 |

TABLE 2-2-continued

| Compound No. | R15 | R16 | R17 | R18 | R19 | R20 | R21 | p1 | p2 |
|---|---|---|---|---|---|---|---|---|---|
| BTA-61 | H | H | H | 3-$CH_3$ | H | 3-$CH_3$ | H | 1 | 1 |
| BTA-62 | H | H | H | H | H | 4-Cl | 4-Cl | 1 | 1 |
| BTA-63 | H | H | 4-$CH_3$ | H | H | H | H | 1 | 1 |
| BTA-64 | H | H | 4-$CH_3$ | 4-$CH_3$ | 4-$CH_3$ | 4-$CH_3$ | 4-$CH_3$ | 1 | 1 |
| BTA-65 | 3-$CH_3$ | 3-$CH_3$ | 4-$CH_3$ | H | H | 4-$CH_3$ | 4-$CH_3$ | 1 | 1 |
| BTA-66 | H | H | 4-$CH_3$ | 4-$CH_3$ | H | 4-$CH_3$ | H | 1 | 1 |
| BTA-67 | H | H | 4-$CH_3$ | 3-$CH_3$ | H | 3-$CH_3$ | H | 1 | 1 |
| BTA-68 | H | H | 4-$CH_3$ | H | H | 4-Cl | 4-Cl | 1 | 1 |
| BTA-69 | H | H | 2-$CH_3$ | H | H | H | H | 1 | 1 |
| BTA-70 | H | H | 2-$CH_3$ | 4-$CH_3$ | 4-$CH_3$ | 4-$CH_3$ | 4-$CH_3$ | 1 | 1 |
| BTA-71 | H | H | 2-$CH_3$ | H | H | 4-$CH_3$ | 4-$CH_3$ | 1 | 1 |
| BTA-72 | H | H | 2-$CH_3$ | 4-$CH_3$ | H | 4-$CH_3$ | H | 1 | 1 |
| BTA-73 | H | 3-$OCH_3$ | 2-$CH_3$ | 3-$CH_3$ | H | 3-$CH_3$ | H | 1 | 1 |
| BTA-74 | H | H | 2-$CH_3$ | H | H | 4-Cl | 4-Cl | 1 | 1 |
| BTA-75 | H | H | 4-$OCH_3$ | H | H | H | H | 1 | 1 |

TABLE 2-3

| Compound No. | R15 | R16 | R17 | R18 | R19 | R20 | R21 | p1 | p2 |
|---|---|---|---|---|---|---|---|---|---|
| BTA-76 | H | H | 4-$OCH_3$ | 4-$CH_3$ | 4-$CH_3$ | 4-$CH_3$ | 4-$CH_3$ | 1 | 1 |
| BTA-77 | H | H | 4-$OCH_3$ | H | H | 4-$CH_3$ | 4-$CH_3$ | 1 | 1 |
| BTA-78 | H | H | 4-$OCH_3$ | 4-$CH_3$ | H | 4-$CH_3$ | H | 1 | 1 |
| BTA-79 | H | H | 4-$OCH_3$ | 3-$CH_3$ | H | 3-$CH_3$ | H | 1 | 1 |
| BTA-80 | H | H | 4-$OCH_3$ | H | H | 4-Cl | 4-Cl | 1 | 1 |
| BTA-81 | H | H | 4-Br | 4-$CH_3$ | 4-$CH_3$ | 4-$CH_3$ | 4-$CH_3$ | 1 | 1 |
| BTA-82 | H | H | 4-Br | 4-$CH_3$ | H | 4-$CH_3$ | H | 1 | 1 |
| BTA-83 | H | H | 4-Br | 4-F | 4-F | 4-F | 4-F | 1 | 1 |
| BTA-84 | H | H | 4-Br | H | H | H | H | 1 | 1 |

Any known charge transport materials, i.e., electron transport materials and hole transport materials can be used in combination with the electron transport material having the formula (1) and the hole transport material having the formula (2) in the present invention.

Specific examples of such electron transport materials include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and benzoquinone derivatives. These electron transport materials can be used alone or in combination.

Specific examples of such hole transport materials include, but are not limited to, electron donating materials such as oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These hole transport materials can be used alone or in combination.

Any known resins can be used for a binder resin of the photosensitive layer. Specific examples of the binder resins include, but are not limited to, thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl chloride, polyvinylidene chloride, polyarylate resin, polycarbonate, cellulose acetate resin, ethylcellulose resin, polyvinyl butyral, polyvinyl formal, polyvinyl toluene, acrylic resin, silicone resin, fluorocarbon resin, epoxy resin, melamine resin, urethane resin, phenol resin, and alkyd resin. Among these resins, polycarbonates are preferably used in terms of quality of the resultant photosensitive layer.

The photosensitive layer is preferably formed by a casting method. For example, a coating liquid, in which a charge generation material, charge transport materials, a binder resin, and the like, are dispersed or dissolved in a solvent at a proper concentration, is applied to the conductive substrate, thereby forming a photosensitive layer.

To evenly disperse a charge generation material in the photosensitive layer (i.e., the coating liquid), the charge generation layer is preferably pre-dispersed in a solvent such as tetrahydrofuran, cyclohexanone, dioxane, dichloroethane, and butanone together with a binder resin using a ball mill, an attritor, a sand mill, or the like. The coating liquid can be applied by a dip coating method, a spray coating method, a bead coating method, or the like method.

Specific examples of the solvents used for the photosensitive layer coating liquid include, but are not limited to, ketones such as methyl ethyl ketone, acetone, methyl isobutyl ketone, and cyclohexanone; ethers such as dioxane, tetrahydrofuran, and ethyl cellosolve; aromatic compounds such as toluene and xylene; halogenated compounds such as chlorobenzene and dichloromethane; and esters such as ethyl acetate and butyl acetate. These solvents can be used alone or in combination.

The photosensitive layer preferably includes charge generation materials in an amount of from 0.1 to 30% by weight, and more preferably from 0.5 to 10% by weight, based on the total weight of the photosensitive layer. The photosensitive layer preferably includes electron transport materials in an amount of from 5 to 300 parts by weight, and more preferably from 10 to 150 parts by weight, based on 100 parts by weight of binder resins. The electron transport materials preferably include the electron transport material having the formula (1) in an amount of from 50 to 100% by weight based on the total weight of the electron transport materials. The photosensitive layer preferably includes hole transport materials in an amount of from 5 to 300 parts by weight, and more preferably from 20 to 150 parts by weight, based on 100 parts by weight of binder resins. The hole transport materials preferably include the hole transport material having the formula (2) in an amount of from 50 to 100% by weight based on the total weight of the hole transport materials. The total amount of electron transport materials and hole transport materials is preferably 20 to 300 parts by weight, and more preferably 30 to 200 parts by weight, based on 100 parts by weight of binder resins.

The photosensitive layer may optionally include a low-molecular compound such as an antioxidant, a plasticizer, a lubricant, and an ultraviolet absorber; and a leveling agent, if desired. These compounds can be used alone or in combination. The photosensitive layer preferably includes a low-molecular compound in an amount of from 0.1 to 50 parts by weight, and more preferably from 0.1 to 20 parts by weight, based on 100 parts by weight of binder resins. The photosensitive layer preferably includes a leveling agent in an amount of from 0.001 to 5 parts by weight based on 100 parts by weight of binder resins.

The photosensitive layer preferably has a thickness of from 5 to 40 μm, and more preferably from 15 to 35 μm.

Figure 2:
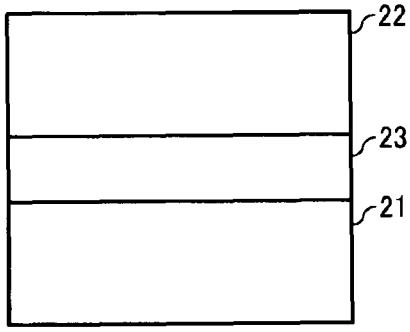
FIG. 2 is a cross-sectional schematic view illustrating another embodiment of the photoreceptor of the present invention.

The photoreceptor of the present invention may include an undercoat layer 23 located overlying the conductive substrate 21 and underlying the photosensitive layer 22, as illustrated in FIG. 2. The undercoat layer is formed for the purpose of improving adhesion properties and coating performance of upper layers, reducing residual potential, and preventing charge injection from the conductive substrate.

The undercoat layer typically includes a resin as a main component. Since the photosensitive layer is typically formed on the undercoat layer by a wet coating method, the undercoat layer preferably has a good resistance to the solvent included in the coating liquid of the photosensitive layer. Suitable resins for use in the undercoat layer include, but are not limited to, water-soluble resins such as polyvinyl alcohol, casein, and sodium polyacrylate; alcohol-soluble resins such as copolymer nylon and methoxymethylated nylon; and cured resins forming a three-dimensional network structure such as polyurethane, melamine resins, alkyd-melamine resins, and epoxy resins.

The undercoat layer may include fine powders of metal oxides such as titanium oxide, silica, alumina, zirconium oxide, tin oxide, and indium oxide, metal sulfides, and metal nitrides. The undercoat layer can be formed by a coating method using a proper solvent, in the same way as the photosensitive layer.

In addition, a metal oxide layer prepared by a sol-gel method using a silane coupling agent, a titan coupling agent, and a chrome coupling agent, etc. can be used as the undercoat layer. Furthermore, an alumina prepared by anodic oxidization; and thin films of organic materials such as polyparaxylylene (parylene) and inorganic materials such as silicon oxide, tin oxide, titanium oxide, ITO, and ceria prepared by a vacuum method can also be used as the undercoat layer.

The undercoat layer preferably has a thickness of from 0.1 to 10 μm, and more preferably from 1 to 5 μm.

Next, example embodiments of image forming apparatuses of the present invention will be explained referring to drawings. For the sake of simplicity, the same reference number will be given to identical constituent elements such as parts and materials having the same functions and redundant descriptions thereof omitted unless otherwise stated.

Figure 3:
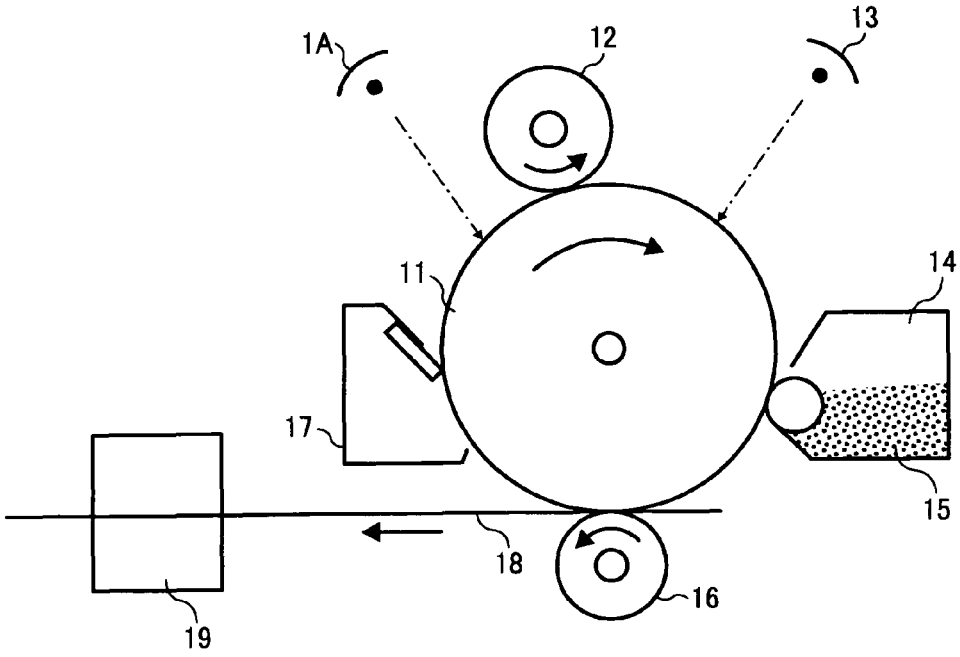
FIG. 3 is a schematic-view illustrating an embodiment of an image forming apparatus of the present invention.

FIG. 3 is a schematic view illustrating an embodiment of an image forming apparatus of the present invention.

A photoreceptor 11 is a photoreceptor according to an example embodiment of the present invention. Although the photoreceptor 11 illustrated in FIG. 3 has a drum-like shape, the photoreceptor 11 may have a sheet-like or endless-belt-like shape.

Specific examples of a charger 12 include, but are not limited to, a corotron, a scorotron, a solid state charger, and a charging roller. The charger 12 is preferably provided in contact with or adjacent to the photoreceptor 11, in terms of reducing electric power consumption. Particularly, a charger provided adjacent to the photoreceptor 11 to form a reasonable gap from the surface of the photoreceptor 11 is preferably used because such a charger is hardly contaminated.

The charger 12 may charge the photoreceptor 11 to either a positive polarity or a negative polarity. In the present invention, the photoreceptor 11 is preferably charged to a positive polarity because the positive charging is stably performed compared to a negative charging, and a less amount of ozone is produced.

Specific examples of a transfer device 16 include, but are not limited to, the above-described chargers. Particularly, a charger in which a transfer charger and a separation charger are combined is preferably used for the transfer device 16.

Suitable light sources used as an irradiator 13 and a diselectrification device 1A include, but are not limited to, illuminants such as fluorescent lamps, tungsten lamps, halogen lamps, mercury lamps, sodium lamps, light emission diodes (LED), laser diodes (LD), and electroluminescent lamps (EL). In addition, in order to obtain light having a desired wavelength range, filters such as sharp-cut filters, band pass filters, near-infrared cutting filters, dichroic filters, interference filters, color temperature converting filters, and the like, can be used.

An electrostatic latent image formed on the photoreceptor 11 is developed with a toner 15 by a developing device 14 to form a toner image thereon. The toner image is then transferred onto a recording medium 18, and fixed thereon by a fixing device 19. Some toner particles may not be transferred onto the recording medium 18 and remain on the photoreceptor 11. The residual toner particles remaining on the photoreceptor 11 are removed therefrom by a cleaning device 17. As the cleaning device 17, a blade made of a rubber, brushes such as a fur brush and a magnet fur brush, and the like, can be used.

Figure 4:
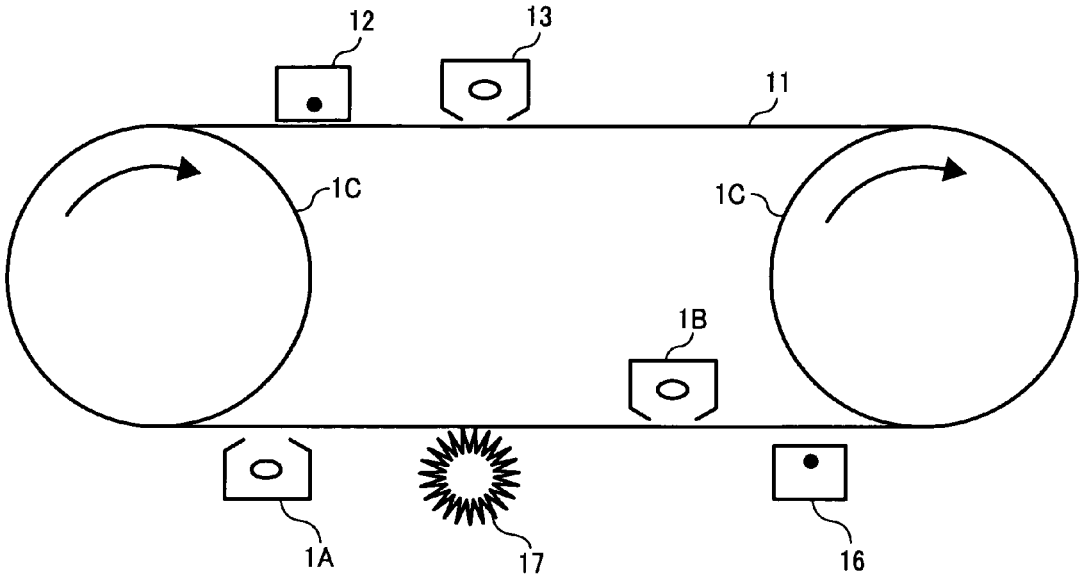
FIG. 4 is a schematic view illustrating another embodiment of an image forming apparatus of the present invention.

FIG. 4 is a schematic view illustrating another embodiment of an image forming apparatus of the present invention. A photoreceptor 11 is a photoreceptor according to an example embodiment of the present invention, having an endless-belt-like shape.

The photoreceptor 11 is driven by driving rollers 1C, charged by a charger 12, and irradiated by an irradiator 13 to form an electrostatic latent image thereon. The electrostatic latent image is developed with a toner by a developing device, not shown, to form a toner image. The toner image is transferred onto a recording medium, not shown, by a transfer device 16. The photoreceptor 11 from which the toner image is transferred is irradiated by a pre-cleaning irradiator 1B, cleaned by a cleaning device 17, and diselectrified by a diselectrification device 1A. The above-described operation is repeatedly performed. In FIG. 4, the pre-cleaning irradiator 1B irradiates the photoreceptor 11 from a side on which the conductive substrate is located (herein after a "backside"). In this case, the conductive substrate has translucency.

Of course, the pre-cleaning irradiator 1B may irradiate the photoreceptor 11 from a side on which the photosensitive layer is formed (hereinafter a "foreside"). In addition, either or both of the irradiator 13 and the diselectrification device 1A may irradiate the photoreceptor 11 from a backside thereof. Furthermore, the photoreceptor 11 may be also irradiated preliminary to the transfer process, the irradiation process performed by the irradiator 13, etc.

Figure 5:
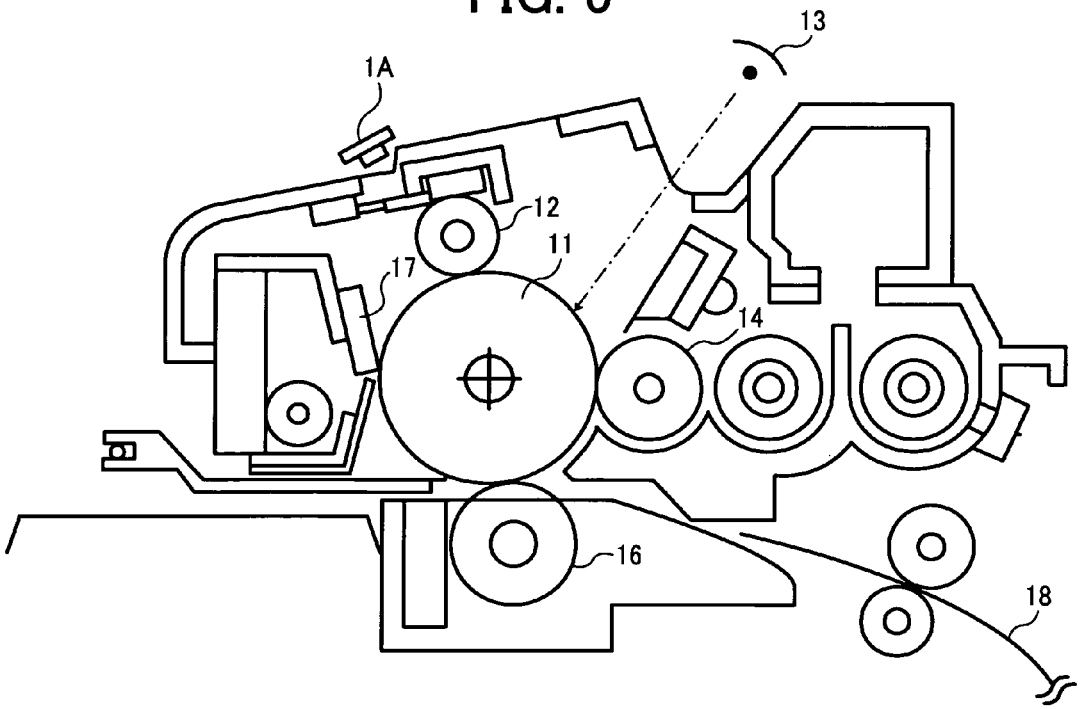
FIG. 5 is a schematic view illustrating an embodiment of a process cartridge of the present invention.

The above-described image forming devices may be fixedly mounted on an image forming apparatus such as a copier, a facsimile, and a printer. Alternatively, the above-described image forming devices may be integrally combined as a process cartridge. A typical process cartridge is a single device (i.e., component) including a photoreceptor, a charger, an irradiator, a developing device, a transfer device, a cleaning device, and a diselectrification device. FIG. 5 is a schematic view illustrating an embodiment of a process cartridge of the present invention, including a photoreceptor 11 which is a photoreceptor according to an example embodiment of the present invention. Although the photoreceptor 11 illustrated in FIG. 5 has a drum-like shape, the photoreceptor 11 may have a sheet-like or endless-belt-like shape.

Figure 6:
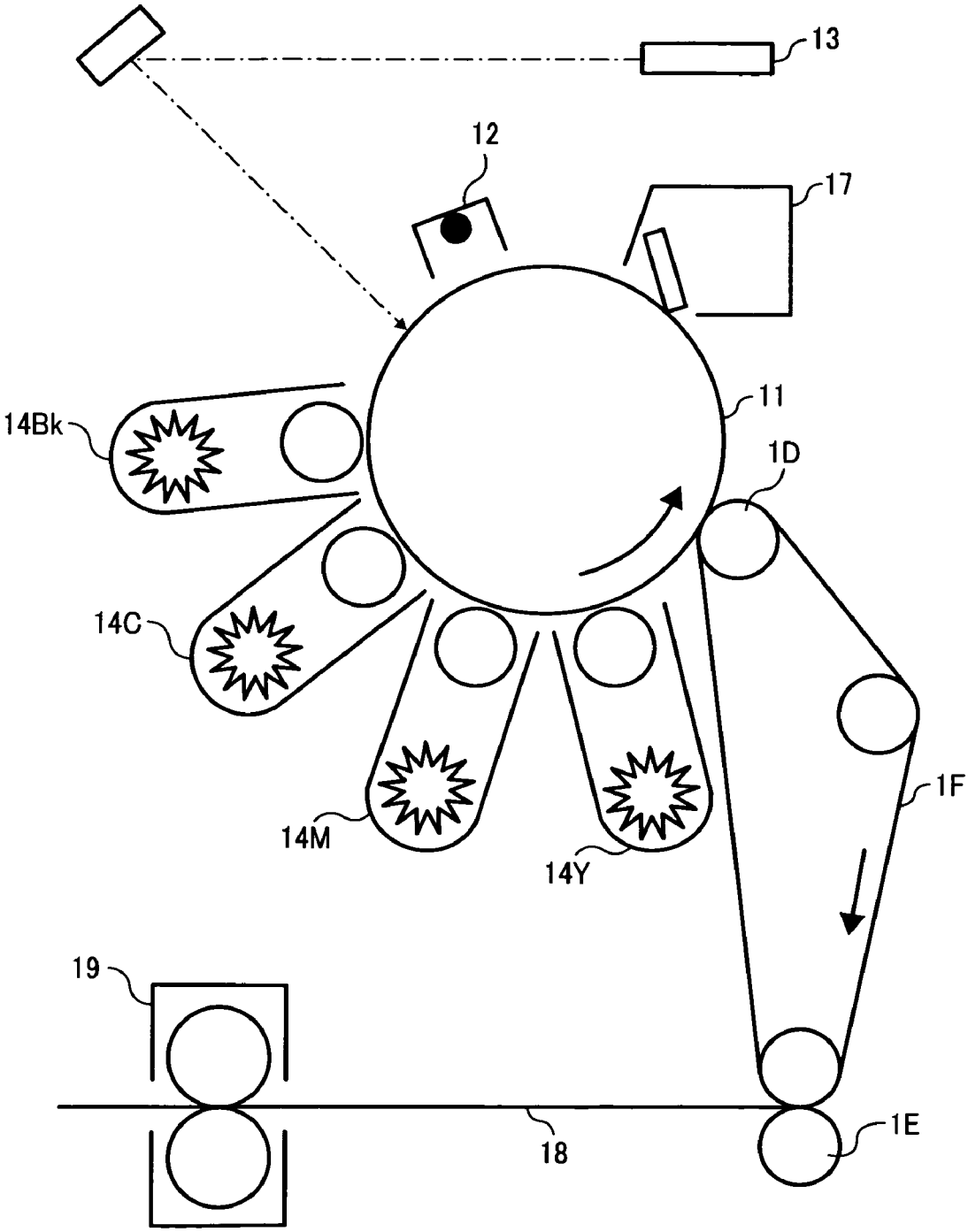
FIG. 6 is a schematic view illustrating an embodiment of a full-color image forming apparatus of the present invention.

FIG. 6 is a schematic view illustrating an embodiment of a full-color image forming apparatus of the present invention. A charger 12, an irradiator 13, developing devices 14Bk, 14C, 14M, and 14Y containing black, cyan, magenta, and yellow toners, respectively, an intermediate transfer belt 1F serving as an intermediate transfer member, and a cleaning device 17 are provided around a photoreceptor 11 in this order. The additional characters Bk, C, M, and Y representing toner colors of black, cyan, magenta, and yellow, respectively, are added or omitted as appropriate.

The photoreceptor 11 is a photoreceptor according to an example embodiment of the present invention. Each of the developing devices 14Bk, 14C, 14M, and 14Y is independently controllable so as to be solely driven at a time of forming an image according to each color. A toner image formed on the photoreceptor 11 is transferred onto the intermediate transfer belt 1F by a primary transfer device 1D provided on an inner side of the intermediate transfer belt 1F. The primary transfer device 1D is capable of moving toward and away from the photoreceptor 11. Only when a toner image is transferred from the photoreceptor 11 onto the intermediate transfer belt 1F, the primary transfer device 1D is brought into contact with the photoreceptor 11 with the intermediate transfer belt 1F therebetween. Toner images of each color are superimposed on one another on the intermediate transfer belt 1F to form a composite toner image. The composite toner image is transferred onto a recording medium 18 by a secondary transfer device 1E, and fixed thereon by a fixing device 19. The secondary transfer device 1E is capable of moving toward and away from the intermediate transfer belt 1F. Only when a toner image is transferred from the intermediate transfer belt 1F onto the recording medium 18, the secondary transfer device 1E is brought into contact with intermediate transfer belt 1F with the recording medium 18 therebetween.

In an electrophotographic image forming apparatus employing a drum-like transfer member (hereinafter a "transfer drum"), toner images of each color formed on the transfer drum are successively transferred onto a recording medium which is electrostatically attracted thereto. Therefore, there is a limitation in choosing the recording medium. For example, thick paper cannot be used for the recording medium. On the other hand, in an electrophotographic image forming apparatus employing an intermediate transfer belt, as illustrated in FIG. 6, toner images of each color are superimposed on one another on the intermediate transfer belt 1F. Therefore, there is no limitation in choosing the recording medium. The intermediate transfer belt can be applied to image forming apparatuses illustrated in FIGS. 1 to 3, 7, and 8 (to be explained later).

Figure 7:
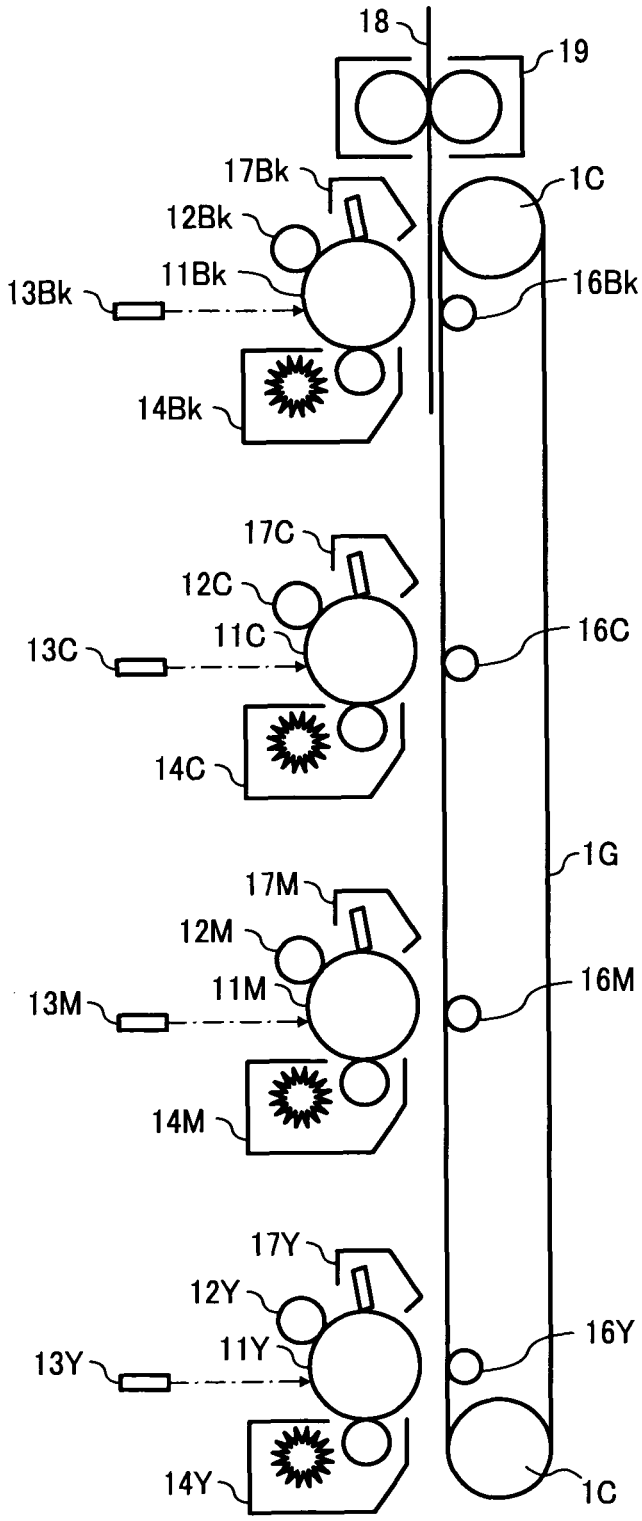
FIG. 7 is a schematic view illustrating another embodiment of a full-color image forming apparatus of the present invention.

FIG. 7 is a schematic view illustrating another embodiment of a full-color image forming apparatus of the present invention. A full-color image forming apparatus illustrated in FIG. 7 includes a yellow image forming unit, a magenta image forming unit, a cyan image forming unit, and a black image forming unit each including photoreceptors 11Y, 11M, 11C, and 11Bk, respectively, that are photoreceptors according to example embodiments of the present invention. Around the photoreceptors 11Y, 11M, 11C, and 11Bk, chargers 12Y, 12M, 12C, and 12Bk, irradiators 13Y, 13M, 13C, and 13Bk, developing devices 14Y, 14M, 14C, and 14Bk, and cleaning devices 17Y, 17M, 17C, and 17Bk are provided, respectively. A conveyance transfer belt 1G serving as a recording medium bearing member, tightly stretched with driving rollers 1C, is provided so as to move toward and away from transfer areas of the photoreceptors 11Y, 11M, 11C, and 11Bk linearly arranged. Transfer devices 16Y, 16M, 16C, and 16Bk are provided on a side opposite to the transfer areas of the photoreceptors 11Y, 11M, 11C, and 11Bk, respectively, relative to the conveyance transfer belt 1G.

Figure 8:
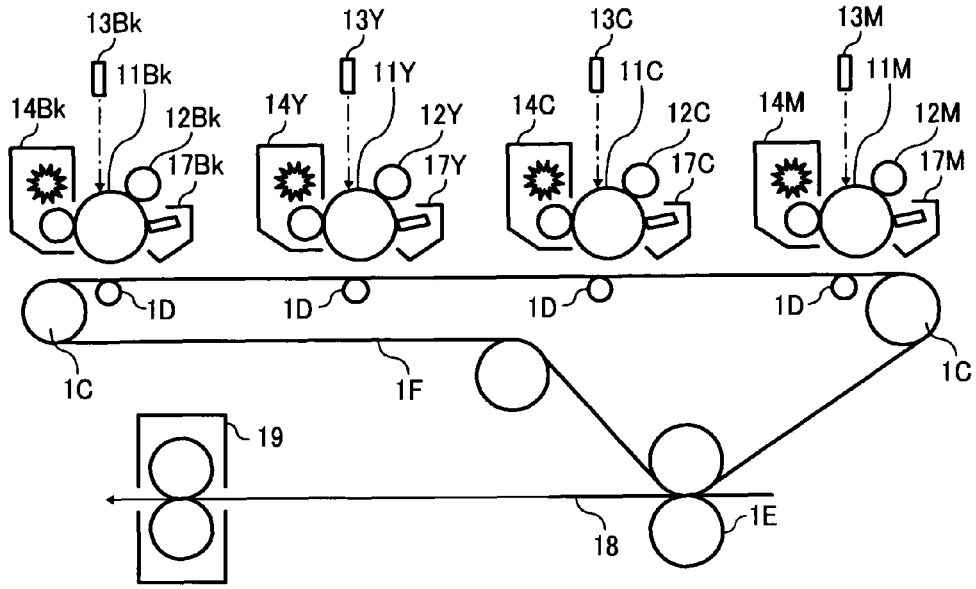
FIG. 8 is a schematic view illustrating yet another embodiment of a full-color image forming apparatus of the present invention.

FIG. 8 is a schematic view illustrating yet another embodiment of a full-color image forming apparatus of the present invention, employing an intermediate transfer belt. A full-color image forming apparatus illustrated in FIG. 8 includes a yellow image forming unit, a magenta image forming unit, a cyan image forming unit, and a black image forming unit each including photoreceptors 11Y, 11M, 11C, and 11Bk, respectively, that are photoreceptors according to example embodiments of the present invention. Around the photoreceptors 11Y, 11M, 11C, and 11Bk, chargers 12Y, 12M, 12C, and 12Bk, irradiators 13Y, 13M, 13C, and 13Bk, developing devices 14Y, 14M, 14C, and 14Bk, and cleaning devices 17Y, 17M, 17C, and 17Bk are provided, respectively. Toner images formed on each of the photoreceptors 11 are transferred onto an intermediate transfer belt 1F by a primary transfer device 1D so as to be superimposed on one another. The toner images of each color superimposed on one another on the intermediate transfer belt 1F are transferred onto a recording medium 18 by a secondary transfer device 1E, and fixed thereon by a fixing device 19.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

At first, 3 parts of a metal-free phthalocyanine (FASTOGEN BLUE 8120B from Dainippon Ink and Chemicals, Incorporated) and 97 parts of cyclohexanone are contained in a glass pot having a diameter of 9 cm, and subjected to a dispersion treatment for 5 hours using PSZ balls having a diameter of 0.5 mm at a revolution of 100 rpm. Thus, a pigment dispersion is prepared.

The following components are mixed to prepare a photosensitive layer coating liquid.

| | |
|---|---|
| Pigment dispersion prepared above | 60 parts |
| Electron transport material No. 1-1 | 20 parts |
| Hole transport material No. BTA-08 | 30 parts |
| Z-type polycarbonate resin (PANLITE ® TS-2050 from Teijin Chemicals Ltd.) | 50 parts |
| Silicone oil (KF50 from Shin-Etsu Chemical Co., Ltd.) | 0.01 parts |
| Tetrahydrofuran | 350 parts |

The thus prepared photosensitive layer coating liquid is applied to an aluminum drum having a diameter of 30 mm and a length of 340 mm by a dip coating method, and subsequently dried for 20 minutes at 120° C. Thus, a photoreceptor (1) including a photosensitive layer having a thickness of 25 μm is prepared.

Example 2

The procedure for preparing the photoreceptor (1) in Example 1 is repeated except that the metal-free phthalocyanine (FASTOGEN BLUE 8120B from Dainippon Ink and Chemicals, Incorporated) is replaced with a titanyl phthalocyanine synthesized according to a method disclosed in JP-A 2001-19871 described below. Thus, a photoreceptor (2) is prepared.

(Preparation of Titanyl Phthalocyanine)

At first, 29.2 g of 1,3-diiminoisoindoline and 200 ml of sulfolane are mixed, and 20.4 g of titanium tetrabutoxide is dropped therein. The mixture is gradually heated to 180° C., and subjected to a reaction for 5 hours at 170 to 180° C. After the reaction is terminated, the mixture stands to cool. The cooled mixture is filtered, and the deposited substance is washed with chloroform until expressing blue color. Subsequently, the deposited substance is washed with methanol for several times, washed with hot water having a temperature of 80° C. for several times, and dried. Thus, a crude titanyl phthalocyanine is prepared.

The crude titanyl phthalocyanine is dissolved in concentrated sulfuric acid 20 times the amount thereof, and subsequently dropped in ice water 100 times the amount thereof while being agitated. The mixture is filtered, and the deposited crystal is washed with ion-exchange water until the used ion-exchange water becomes neutral, in other words, has a pH of 6.8. Thus, a wet cake (i.e., a water paste) of a titanyl phthalocyanine is prepared. Next, 40 g of the wet cake is poured into 200 g of tetrahydrofuran, and the mixture is agitated for 4 hours. Subsequently, the mixture is filtered and dried. Thus, a titanyl phthalocyanine in powder state is prepared.

Figure 9:
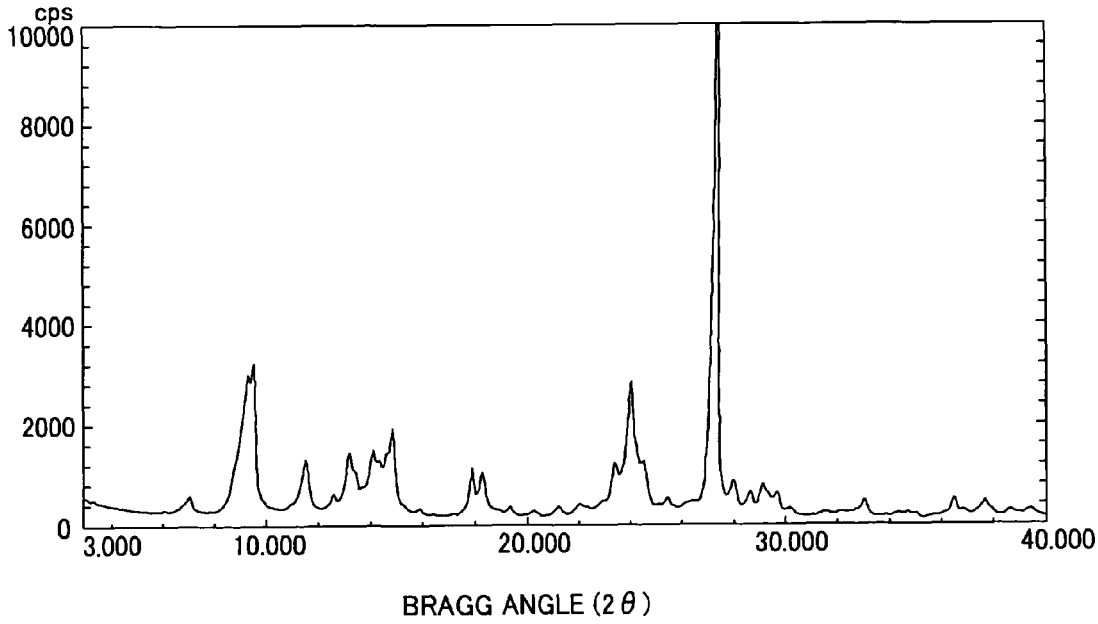
FIG. 9 is an x-ray diffraction spectrum of a titanyl phthalocyanine used for the present invention, obtained with a characteristic X-ray specific to CuKα having a wavelength of 1.542 Å.

FIG. 9 is an x-ray diffraction spectrum of the above-prepared titanyl phthalocyanine, obtained with a characteristic X-ray specific to CuKα having a wavelength of 1.542 Å. Referring to FIG. 9, the titanyl phthalocyanine has a maximum diffraction peak at 27.2°, main diffraction peaks at 9.4°, 9.6°, and 24.0°, a lowest-side-angle diffraction peak at 7.3°, and no diffraction peak in a range of greater than 7.3° and less than 9.4°, as diffraction peaks of Bragg angles (2θ±0.2°).

The x-ray diffraction spectrum is obtained under the following conditions:

X-ray tube: Cu
Voltage: 50 kV
Current: 30 mA
Scanning velocity: 2°/min
Scanning range: 30 to 40°
Time constant: 2 seconds Example 3

The procedure for preparing the photoreceptor (1) in Example 1 is repeated except that 5 parts of a compound having the following formula (4) is further added to the photosensitive layer coating liquid:

(4)

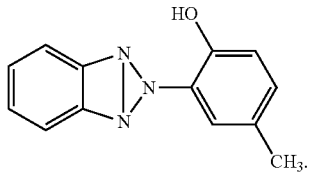

Thus, a photoreceptor (3) is prepared.

Example 4

Figure 10:
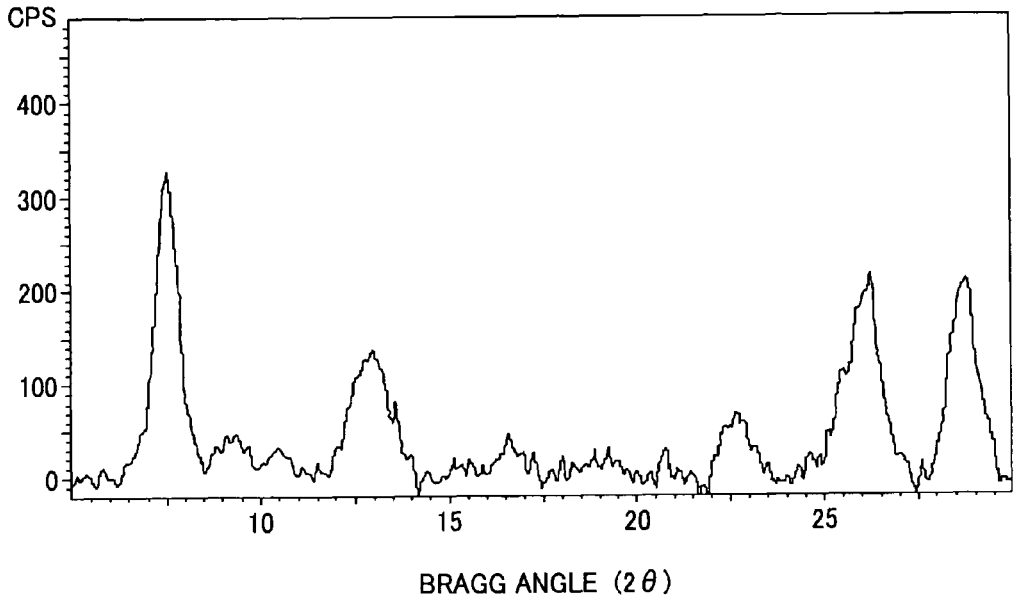
FIG. 10 is an x-ray diffraction spectrum of another titanyl phthalocyanine used for the present invention, obtained with a characteristic X-ray specific to CuKα having a wavelength of 1.542 Å.

The procedure for preparing the photoreceptor (1) in Example 1 is repeated except that the metal-free phthalocyanine (FASTOGEN BLUE 8120B from Dainippon Ink and Chemicals, Incorporated) is replaced with a titanyl phthalocyanine having an X-ray diffraction spectrum illustrated in FIG. 10. Thus, a photoreceptor (4) is prepared.

Example 5

The procedure for preparing the photoreceptor (4) in Example 4 is repeated except that 5 parts of the compound having the formula (4) is further added to the photosensitive layer coating liquid. Thus, a photoreceptor (5) is prepared.

Example 6

The procedure for preparing the photoreceptor (2) in Example 2 is repeated except that the hole transport material No. BTA-08 is replaced with the hole transport material No. BTA-20. Thus, a photoreceptor (6) is prepared.

Example 7

The procedure for preparing the photoreceptor (2) in Example 2 is repeated except that the hole transport material No. BTA-08 is replaced with the hole transport material No. BTA-78. Thus, a photoreceptor (7) is prepared.

Example 8

The procedure for preparing the photoreceptor (2) in Example 2 is repeated except that the electron transport material No. 1-1 is replaced with the electron transport material No. 1-15. Thus, a photoreceptor (8) is prepared.

Example 9

The procedure for preparing the photoreceptor (2) in Example 2 is repeated except that the electron transport material No. 1-1 is replaced with the electron transport material No. 1-17. Thus, a photoreceptor (9) is prepared.

Comparative Example 1

The procedure for preparing the photoreceptor (2) in Example 2 is repeated except that the hole transport material No. BTA-08 is replaced with a hole transport material HTM1 having the following formula:

(HTM1)

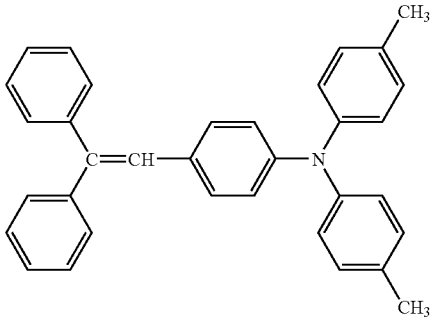

Thus, a photoreceptor (10) is prepared.

Comparative Example 2

The procedure for preparing the photoreceptor (2) in Example 2 is repeated except that the hole transport material No. BTA-08 is replaced with a hole transport material HTM2 having the following formula:

(HTM2)

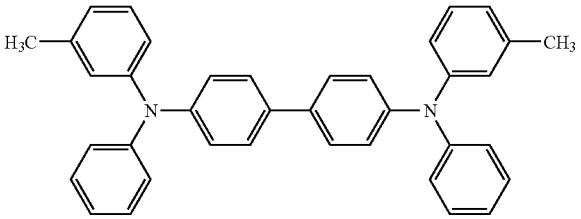

Thus, a photoreceptor (11) is prepared.

Comparative Example 3

The procedure for preparing the photoreceptor (2) in Example 2 is repeated except that the hole transport material No. BTA-08 is replaced with a hole transport material HTM3 having the following formula:

(HTM3)

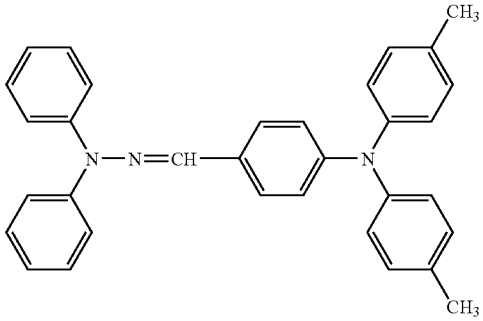

Thus, a photoreceptor (12) is prepared.

Comparative Example 4

The procedure for preparing the photoreceptor (2) in Example 2 is repeated except that the electron transport material No. 1-1 is replaced with an electron transport material ETM1 having the following formula:

(ETM1)

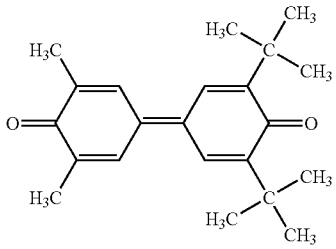

Thus, a photoreceptor (13) is prepared.

Comparative Example 5

The procedure for preparing the photoreceptor (2) in Example 2 is repeated except that the electron transport material No. 1-1 is replaced with an electron transport-material ETM2 having the following formula:

(ETM2)

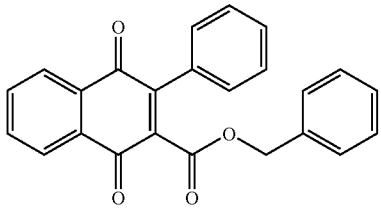

Thus, a photoreceptor (14) is prepared.

Evaluation 1

Each of the above-prepared photoreceptors 1 to 14 is mounted on a modified image forming apparatus (IMAGIO NEO 270 from Ricoh Co., Ltd.) in which a power pack is replaced so that the photoreceptor is charged to positive. A running test in which 50,000 sheets of an image chart, evenly including characters occupying 5% of the area, are continuously produced is performed.

The toner and developer originally contained in IMAGIO NEO270 are replaced with a toner and developer having the reverse polarity to them.

A bias is applied to the charging roller from an external power source so that the photoreceptor is initially charged to an electric potential of +600 V. This charging condition is maintained through the running test. The developing bias is +450 V. The running test is performed under a condition of 23° C. and 55% RH.

Figure 11A:
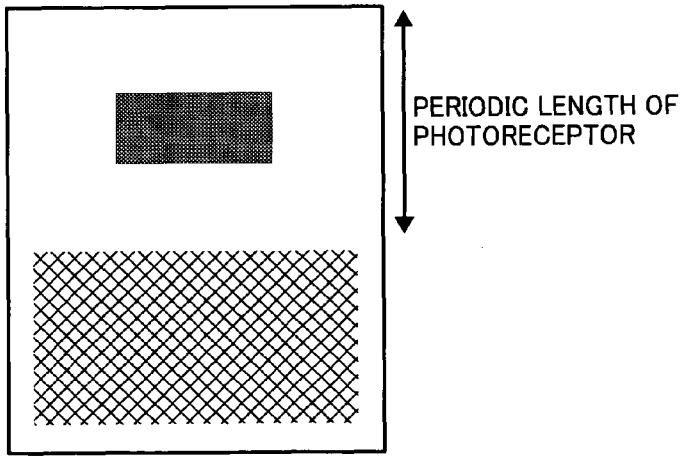
FIG. 11A is an example of an image including a solid image and a halftone image to evaluate whether or not residual image is observed.
Figure 11B:
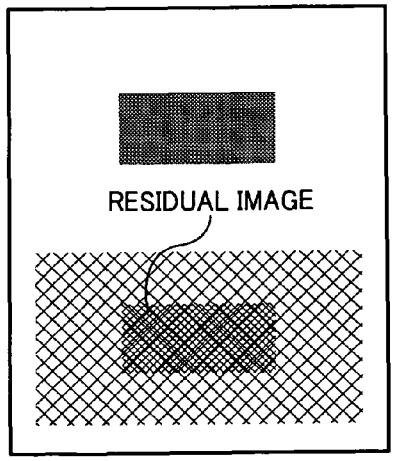
FIG. 11B is an example of a produced image including a residual image.

Before and after the running test is performed, dark section potential and bright section potential of the photoreceptor are measured and the resultant image is evaluated whether or not residual image is observed, as described below. The dark section potential is a surface potential of the photoreceptor, which is conveyed to a developing area after being primarily charged. The bright section potential is a surface potential of the photoreceptor, which is conveyed to a developing area after being primarily charged and irradiated with a light beam containing image information. An image including a solid image and a halftone image, as illustrated in FIG. 11A, is produced to evaluate whether or not residual image is observed. FIG. 11B is an example of a produced image including a residual image. Residual image is evaluated according to the following ranks.

Very good: No residual image is observed.

Good: Residual image is slightly observed.

Average: Residual image is observed.

Poor: Residual image is seriously observed.

The results of Evaluation 1 are shown in Tables 1-1 and 1-2.

TABLE 1-1

| | | Dark section potential (V) | | Bright section potential (V) | |
|---|---|---|---|---|---|
| | Photoreceptor No. | Initial stage | After printing 50,000 sheets | Initial stage | After printing 50,000 sheets |
| Ex. 1 | 1 | 600 | 590 | 100 | 100 |
| Ex. 2 | 2 | 600 | 580 | 80 | 80 |
| Ex. 3 | 3 | 600 | 590 | 80 | 80 |
| Ex. 4 | 4 | 600 | 560 | 110 | 120 |
| Ex. 5 | 5 | 600 | 580 | 100 | 110 |
| Ex. 6 | 6 | 600 | 580 | 80 | 90 |
| Ex. 7 | 7 | 600 | 570 | 80 | 90 |
| Ex. 8 | 8 | 600 | 580 | 90 | 90 |
| Ex. 9 | 9 | 600 | 580 | 90 | 100 |
| Comp. Ex. 1 | 10 | 600 | 550 | 120 | 150 |
| Comp. Ex. 2 | 11 | 600 | 520 | 120 | 160 |
| Comp. Ex. 3 | 12 | 600 | 440 | 100 | 150 |
| Comp. Ex. 4 | 13 | 600 | 480 | 150 | 250 |
| Comp. Ex. 5 | 14 | 600 | 500 | 130 | 200 |

TABLE 1-2

| | | Residual image | | |
|---|---|---|---|---|
| | Photoreceptor No. | Initial stage | After printing 50,000 sheets | Image quality After printing 50,000 sheets |
| Ex. 1 | 1 | Very good | Good | Very good |
| Ex. 2 | 2 | Very good | Good | Very good |
| Ex. 3 | 3 | Very good | Very good | Very good |
| Ex. 4 | 4 | Very good | Very good | Very good |
| Ex. 5 | 5 | Very good | Very good | Very good |
| Ex. 6 | 6 | Very good | Very good | Very good |
| Ex. 7 | 7 | Very good | Very good | Very good |
| Ex. 8 | 8 | Very good | Very good | Very good |
| Ex. 9 | 9 | Very good | Very good | Very good |
| Comp. Ex. 1 | 10 | Very good | Average | Residual image |
| Comp. Ex. 2 | 11 | Very good | Average | Residual image |
| Comp. Ex. 3 | 12 | Very good | Average | Background fouling |
| Comp. Ex. 4 | 13 | Good | Poor | Low image density |
| Comp. Ex. 5 | 14 | Good | Poor | Low image density |

Evaluation 2

Each of the above-prepared photoreceptors 1 to 14 is mounted on a modified full-color tandem image forming apparatus (IPSIO COLOR8100 from Ricoh Co., Ltd.) in which a power pack is replaced so that the photoreceptor is charged to positive and a laser diode for use in writing is replaced with that having a wavelength of 780 nm. A running test in which 10,000 sheets of an image chart, evenly including characters occupying 5% of the area, are continuously produced is performed.

The toner and developer originally contained in IPSIO COLOR 8100 are replaced with a toner and developer having the reverse polarity to them.

A bias is applied to the charging roller from an external power source. The bias includes an alternate current (AC) having a peak interval potential of 1.9 kV and a frequency of 1.35 kHz and a direct current (DC) so that the photoreceptor is initially charged to an electric potential of +600 V. This charging condition is maintained through the running test. The developing bias is +450 V. The running test is performed under a condition of 23° C. and 55% RH.

Similar to Evaluation 1, the resultant image is evaluated whether or not residual image is observed after the running test is performed. In addition, ISO/JIS-SCID image Ni (portrait) is produced after the running test is performed, to evaluate color reproducibility of the produced image.

The results of Evaluation 2 are shown in Table 2.

TABLE 2

| | Photoreceptor No. | Residual image | Color reproducibility |
|---|---|---|---|
| Ex. 1 | 1 | Good | Very good |
| Ex. 2 | 2 | Very good | Very good |
| Ex. 3 | 3 | Very good | Very good |
| Ex. 4 | 4 | Good | Very good |
| Ex. 5 | 5 | Very good | Very good |

TABLE 2-continued

| | Photoreceptor No. | Residual image | Color reproducibility |
|---|---|---|---|
| Ex. 6 | 6 | Very good | Very good |
| Ex. 7 | 7 | Very good | Very good |
| Ex. 8 | 8 | Very good | Very good |
| Ex. 9 | 9 | Very good | Very good |
| Comp. Ex. 1 | 10 | Average | Good |
| Comp. Ex. 2 | 11 | Average | Good |
| Comp. Ex. 3 | 12 | Average | Good |
| Comp. Ex. 4 | 13 | Poor | Poor |
| Comp. Ex. 5 | 14 | Poor | Average |

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2007-126238, filed on May 11, 2007, the entire contents of which are herein incorporated by reference.

What is claimed is:

1. An electrophotographic photoreceptor, comprising:

a conductive substrate; and a photosensitive layer located overlying the conductive substrate, comprising:

a charge generation material;

an electron transport material; and a hole transport material having the following formula (2):

(2)

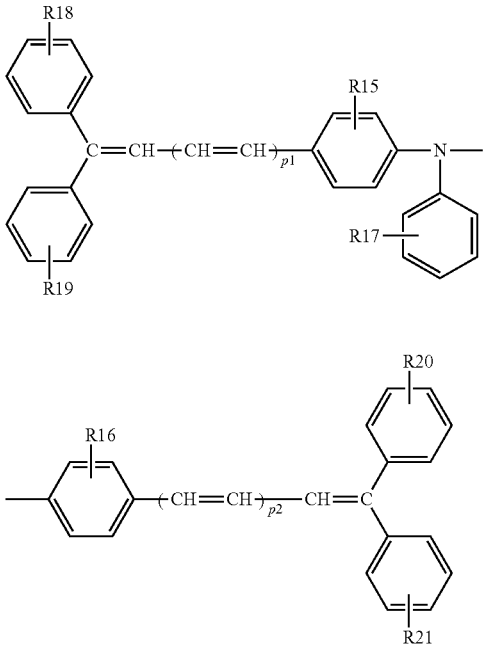

wherein each of R15 to R21 independently represents a hydrogen atom, a lower alkyl group, an alkoxy group, a phenoxy group, a halogen atom, or an aryl group which may have a substituent group;

and each of p1 and p2 independently represents an integer of 0 or 1, and wherein the electron transport material is at least one member selected from the group consisting of the following compounds (1- 1), (1-15), and (1-17):

(1-1)

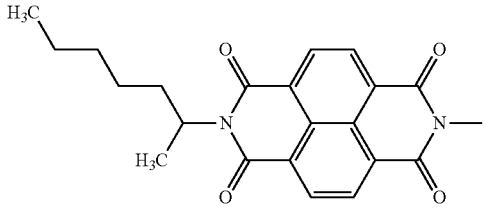

and the hole transport material is at least one member selected from the group consisting of a compound BTA-08 having the formula (2) wherein R15 is H, R16 is H, R17 is 4-$CH_3$, R18 is 4-$CH_3$, R19 is 4-$CH_3$, R20 is 4-$CH_3$, R21 is 4-$CH_3$, p1 is 0, and p2 is 0; a compound BTA-20 having the formula (2) wherein R15 is H, R16 is H, R17 is 4-$OCH_3$, R18 is 4-$CH_3$, R19 is 4-$CH_3$, R20 is 4-$CH_3$, R21 is 4-$CH_3$, p1 is 0, and p2 is 0; and a compound BTA-78 having the formula (2) wherein R15 is H, R16 is H, R17 is 4-$OCH_3$, R18 is 4-$CH_3$, R19 is H, R20 is 4-$CH_3$, R21 is H, p1 is 1, and p2 is 1.

2. The electrophotographic photoreceptor according to claim 1, wherein the photosensitive layer further comprises a compound having the following formula (4):

(4)

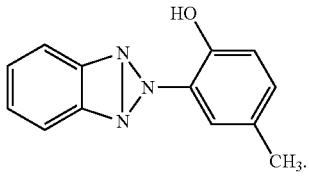

3. The electrophotographic photoreceptor according to claim 1, wherein the charge generation material comprises a phthalocyanine.

4. The electrophotographic photoreceptor according to claim 3, wherein the phthalocyanine comprises a titanyl phthalocyanine.

5. The electrophotographic photoreceptor according to claim 4, wherein the titanyl phthalocyanine has a maximum diffraction peak at 27.2°, main diffraction peaks at 9.4°, 9.6°, and 24.0°, a lowest-side-angle diffraction peak at 7.3°, and no diffraction peak in a range of greater than 7.3° and less than 9.4°, as diffraction peaks of Bragg angles (2θ±0.2°) with a characteristic X-ray specific to CuKα having a wavelength of 1.542 Å.

* * * * *